US011469483B2

(12) United States Patent
Ogawa

(10) Patent No.: US 11,469,483 B2
(45) Date of Patent: Oct. 11, 2022

(54) FILTER

(71) Applicant: Soshin Electric Co., Ltd., Saku (JP)

(72) Inventor: Keisuke Ogawa, Otsu (JP)

(73) Assignee: Soshin Electric Co., Ltd., Saku (JP)

( * ) Notice: Subject to any disclaimer, the term of this patent is extended or adjusted under 35 U.S.C. 154(b) by 0 days.

(21) Appl. No.: 17/309,019

(22) PCT Filed: Oct. 1, 2019

(86) PCT No.: PCT/JP2019/038672

§ 371 (c)(1),
(2) Date: Apr. 14, 2021

(87) PCT Pub. No.: WO2020/080090

PCT Pub. Date: Apr. 23, 2020

(65) Prior Publication Data

US 2022/0037755 A1 Feb. 3, 2022

(30) Foreign Application Priority Data

Oct. 19, 2018 (JP) ..... JP2018-197673

(51) Int. Cl.
*H01P 1/20* (2006.01)
*H01P 1/203* (2006.01)
*H01P 7/08* (2006.01)

(52) U.S. Cl.
CPC ..... *H01P 1/20336* (2013.01); *H01P 1/20* (2013.01); *H01P 7/082* (2013.01)

(58) Field of Classification Search
CPC ..... H01P 1/20336; H01P 1/203; H01P 1/20; H01P 1/201; H01P 7/10; H01P 7/08; H01P 7/04; H01P 7/082; H03H 7/01; H03H 7/0115; H03H 7/0123
See application file for complete search history.

(56) References Cited

U.S. PATENT DOCUMENTS

2007/0085108 A1 4/2007 White et al.
2010/0265015 A1 10/2010 Hoeft et al.
2015/0236427 A1 8/2015 Asai

FOREIGN PATENT DOCUMENTS

CN 207651641 U 7/2018
JP S59-110201 A1 6/1984
JP H03-293 802 A1 12/1991
(Continued)

OTHER PUBLICATIONS

Japanese Office Action (Application No. 2020-202374) dated Oct. 5, 2021 (with English translation).
(Continued)

*Primary Examiner* — Stephen E. Jones
(74) *Attorney, Agent, or Firm* — Burr & Brown, PLLC

(57) ABSTRACT

The present invention provides a compact filter with excellent characteristics. This filter has a plurality of resonators, each of which having: via electrode parts formed inside a dielectric substrate; and a first strip line that faces a first shielding conductor of a plurality of shielding conductors formed so as to surround the via electrode parts, the first strip line being connected to one end of the via electrode parts. The positions of the via electrode parts of the first resonator of the plurality of resonators, and the positions of the via electrode parts of the second resonator, which is adjacent to the first resonator, are mutually offset in a first direction (X), which is the longitudinal direction of the first strip line.

18 Claims, 17 Drawing Sheets

(56) References Cited

FOREIGN PATENT DOCUMENTS

| | | | |
|---|---|---|---|
| JP | H05-283908 | A1 | 10/1993 |
| JP | H09-191206 | A1 | 7/1997 |
| JP | 2002-111314 | A1 | 4/2002 |
| JP | 2004-147346 | A1 | 5/2004 |
| JP | 2004-228891 | A | 8/2004 |
| JP | 2007-523574 | A1 | 8/2007 |
| JP | 2011-507312 | A1 | 3/2011 |
| JP | 2014-068166 | A1 | 4/2014 |
| JP | 2017-195565 | A1 | 10/2017 |
| KR | 10-1407727 | A | 6/2014 |

OTHER PUBLICATIONS

Japanese Office Action (Application No. 2018-197673) dated Jul. 7, 2020 (with English translation).
Japanese Office Action (Application No. 2018-197673) dated Sep. 23, 2020 (with English translation).
International Search Report and Written Opinion (Application No. PCT/JP2019/038672) dated Dec. 17, 2019 (with Informal Comments).

FILTER

TECHNICAL FIELD

The present invention relates to a filter.

BACKGROUND ART

There has been proposed a resonator that includes: a strip line which faces a shielding conductor formed on one principal surface side of a dielectric substrate; and a via electrode whose one end is connected to a shielding conductor formed on the other principal surface side of the dielectric substrate, and whose other end is connected to the strip line.

Moreover, Japanese Laid-Open Patent Publication No. 2011-507312 (PCT) discloses a resonator device in which a coupling adjustment via hole is provided between two resonators. According to Japanese Laid-Open Patent Publication No. 2011-507312 (PCT), inductive coupling (a coupling degree) between the two resonators may be adjusted by the coupling adjustment via hole.

SUMMARY OF INVENTION

However, in Japanese Laid-Open Patent Publication No. 2011-507312 (PCT), although the coupling degree between the resonators can be made smaller, a degree of freedom of adjustment of the coupling degree is narrow, and hence it is conceivable that, in some cases, good characteristics cannot be obtained. Moreover, although it is also conceivable for the coupling degree between the resonators to be adjusted by adjusting a distance between the resonators, without a coupling adjustment via hole being used, if the distance between the resonators is increased, size of the filter will end up increasing.

An object of the present invention is to provide a filter which is small-sized and has good characteristics.

A filter according to an aspect of the present invention includes a plurality of resonators, the plurality of resonators each including a via electrode portion which is formed within a dielectric substrate, and the plurality of resonators each including a first strip line which is connected to one end of the via electrode portion and which faces a first shielding conductor among a plurality of shielding conductors that are formed so as to surround the via electrode portion, wherein a position of the via electrode portion of a first resonator among the plurality of resonators and a position of the via electrode portion of a second resonator adjacent to the first resonator are offset from each other in a first direction being a longitudinal direction of the first strip line.

A filter according to another aspect of the present invention includes: a plurality of resonators, the plurality of resonators each including a via electrode portion which is formed within a dielectric substrate, and the plurality of resonators each including a first strip line which is connected to one end of the via electrode portion and which faces a first shielding conductor among a plurality of shielding conductors that are formed so as to surround the via electrode portion; and a slit which is formed in a second shielding conductor that faces the first shielding conductor, wherein the slit is positioned at least between the via electrode portion of a first resonator among the plurality of resonators and the via electrode portion of a second resonator among the plurality of resonators.

A filter according to yet another aspect of the present invention includes: a plurality of resonators, the plurality of resonators each including a via electrode portion which is formed within a dielectric substrate, and the plurality of resonators each including a first strip line which is connected to one end of the via electrode portion and which faces a first shielding conductor among a plurality of shielding conductors that are formed so as to surround the via electrode portion; and a coupling adjustment via electrode that, within an extension region which is an extension in a first direction being a longitudinal direction of the first strip line, of a region between the first strip line of a first resonator among the plurality of resonators and the first strip line of a second resonator adjacent to the first resonator, has its one end connected to the first shielding conductor and has its another end connected to a second shielding conductor that faces the first shielding conductor.

Due to the present invention, there can be provided a filter which is small-sized and has good characteristics.

DESCRIPTION OF EMBODIMENTS

Preferred embodiments of a filter according to the present invention will be presented and described in detail below with reference to the accompanying drawings.

First Embodiment

Figure 1:
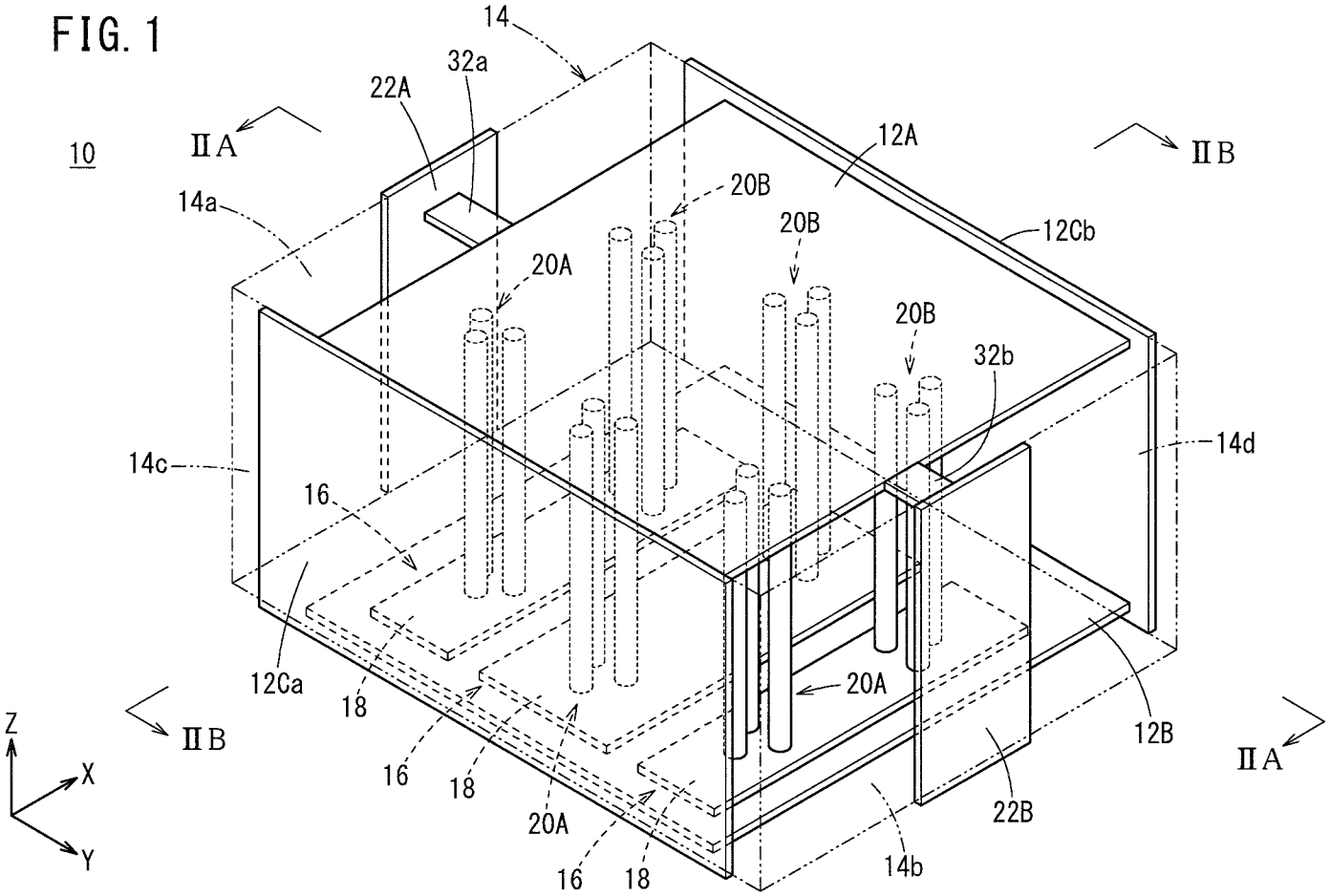
FIG. 1 is a perspective view showing a filter according to a first embodiment.
Figure 2A:
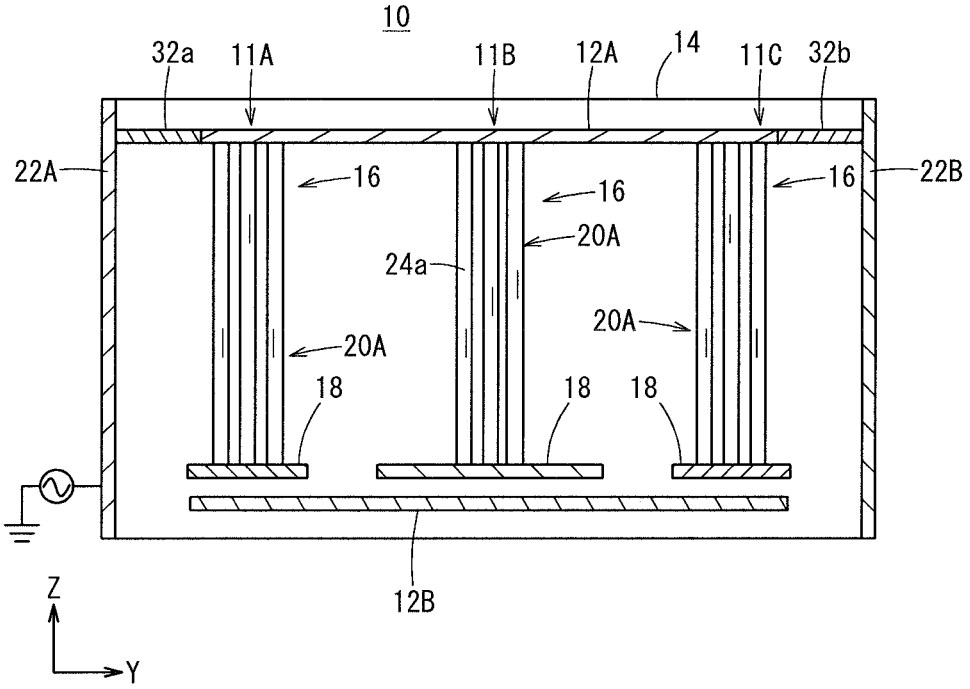
FIGS. 2A and 2B are cross-sectional views showing the filter according to the first embodiment.
Figure 2B:
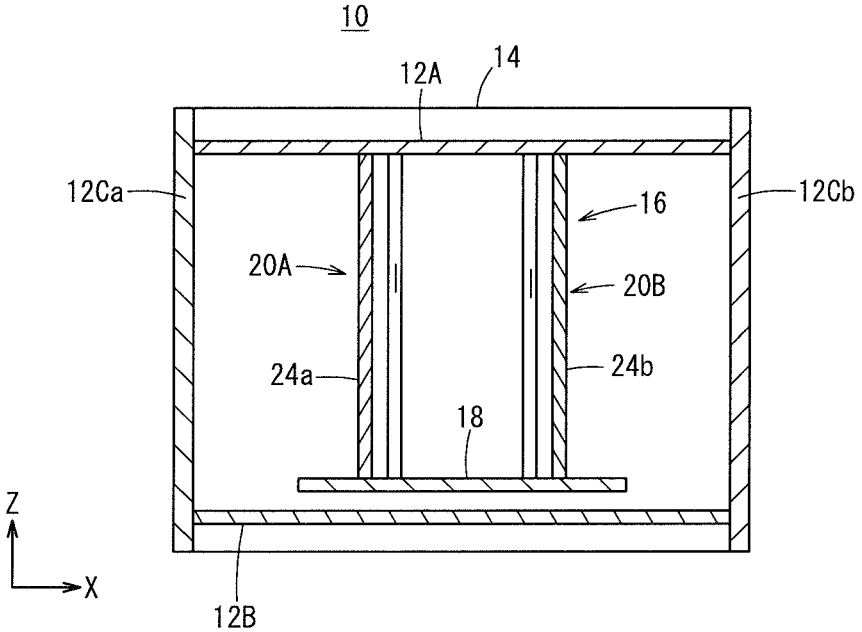

A filter according to a first embodiment will be described using the drawings. FIG. 1 is a perspective view showing the filter according to the present embodiment. FIGS. 2A and 2B are cross-sectional views showing the filter according to the present embodiment. FIG. 2A corresponds to the line IIA-IIA of FIG. 1. FIG. 2B corresponds to the line IIB-IIB of FIG. 1.

As shown in FIG. 1, a filter 10 according to the present embodiment includes a dielectric substrate 14. The dielectric substrate 14 is formed in a parallelepiped shape, for example. The dielectric substrate 14 is configured by laminating a plurality of ceramics sheets (dielectric ceramics sheets). The dielectric substrate 14 has four side surfaces 14*a* to 14*d*. A direction normal to a side surface (a first side surface) 14*c* and a side surface (a second side surface) 14*d* is assumed to be an X direction (a first direction). A direction normal to a side surface (a third side surface) 14*a* and a side surface (a fourth side surface) 14*b* is assumed to be a Y direction (a second direction). A direction normal to one principal surface and another principal surface of the dielectric substrate 14 is assumed to be a Z direction.

On a side of the one principal surface of the dielectric substrate 14, that is, on an upper side of the dielectric substrate 14 in FIG. 1, there is formed an upper shielding conductor (a shielding conductor, a second shielding conductor) 12A. On a side of the other principal surface of the dielectric substrate 14, that is, on a lower side of the dielectric substrate 14 in FIG. 1, there is formed a lower shielding conductor (a shielding conductor, a first shielding conductor) 12B.

The dielectric substrate 14 has formed therein a strip line (a first strip line) 18 that faces the lower shielding conductor 12B. A longitudinal direction of the strip line 18 is the X direction.

The dielectric substrate 14 has further formed therein a via electrode portion (a first via electrode portion) 20A and a via electrode portion (a second via electrode portion) 20B. One end of the via electrode portions 20A, 20B is connected to the strip line 18. The other end of the via electrode portions 20A, 20B is connected to the upper shielding conductor 12A. Thus, the via electrode portions 20A, 20B are formed from the strip line 18 to the upper shielding conductor 12A. The strip line 18 and the via electrode portions 20A, 20B configure a structure 16. The filter 10 is provided with a plurality of resonators, that is, a first resonator 11A, a second resonator 11B, and a third resonator 11C, which each include the structure 16. The first resonator (a resonator) 11A, the second resonator (a resonator) 11B, and the third resonator (a resonator) 11C are arranged adjacently to each other in the Y direction. The second resonator 11B is positioned between the first resonator 11A and the third resonator 11C.

The side surface 14*a* of the dielectric substrate 14 has formed thereon a first input/output terminal 22A. The side surface 14*b* of the dielectric substrate 14 has formed thereon a second input/output terminal 22B. The first input/output terminal 22A is coupled to the upper shielding conductor 12A via a first connection line 32*a*. Moreover, the second input/output terminal 22B is coupled to the upper shielding conductor 12A via a second connection line 32*b*. The first resonator 11A is positioned between the first input/output terminal 22A and the second resonator 11B. The third resonator 11C is positioned between the second input/output terminal 22B and the second resonator 11B. The side surface 14*c* of the dielectric substrate 14 has formed thereon a first side surface shielding conductor (a shielding conductor) 12Ca. The side surface 14*d* of the dielectric substrate 14 has formed thereon a second side surface shielding conductor (a shielding conductor) 12Cb. In the dielectric substrate 14, the first via electrode portion 20A is positioned on a side surface 14*c* side, and the second via electrode portion 20B is positioned on a side surface 14*d* side.

The first via electrode portion 20A is configured from a plurality of via electrodes 24*a*. The second via electrode portion 20B is configured from a plurality of via electrodes 24*b*. The via electrodes 24*a* and the via electrodes 24*b* are each embedded in a via hole formed in the dielectric substrate 14. No other via electrode portion exists between the first via electrode portion 20A and the second via electrode portion 20B. An unillustrated pattern (a coupling capacitance electrode) is appropriately provided between each of the structures 16.

Figure 3:
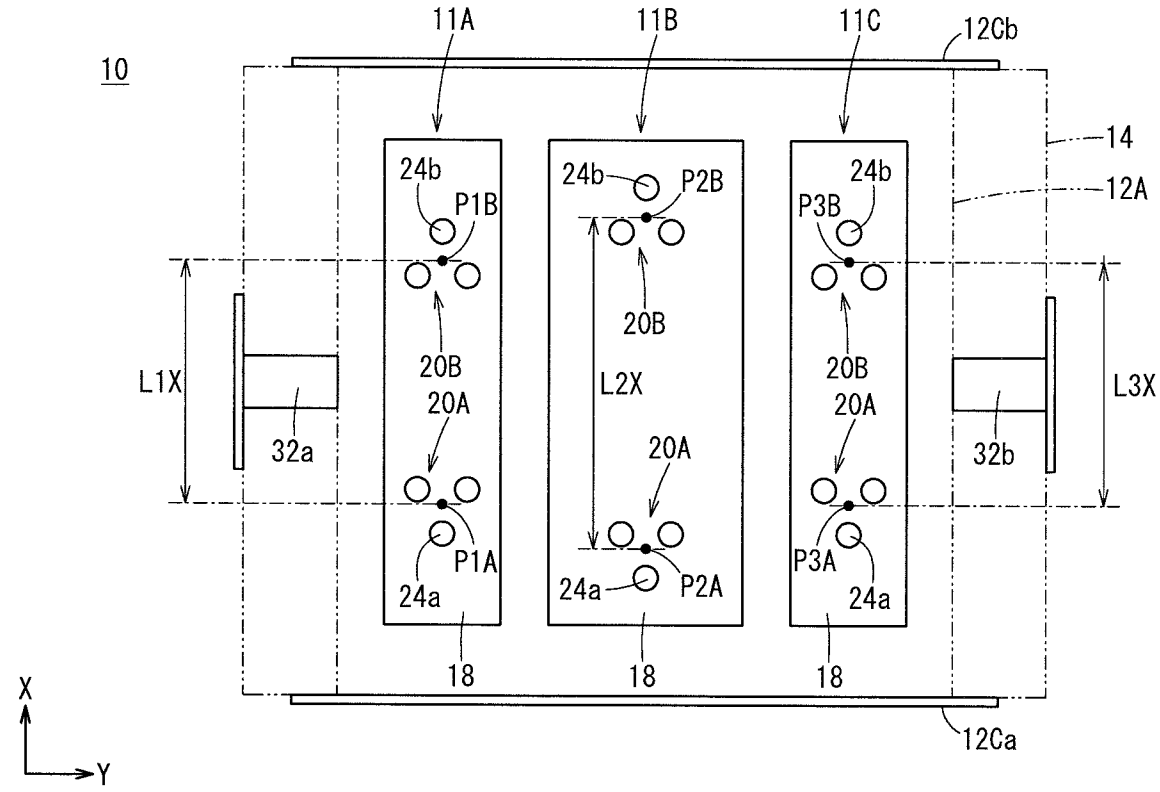
FIG. 3 is a plan view showing the filter according to the first embodiment.

FIG. 3 is a plan view showing the filter according to the present embodiment. As shown in FIG. 3, positions of the via electrode portions 20A, 20B of the first resonator 11A and positions of the via electrode portions 20A, 20B of the second resonator 11B differ from each other in the X direction. Moreover, the positions of the via electrode portions 20A, 20B of the second resonator 11B and positions of the via electrode portions 20A, 20B of the third resonator 11C differ from each other in the X direction.

More specifically, a position P1A of the first via electrode portion 20A of the first resonator 11A and a position P2A of the first via electrode portion 20A of the second resonator 11B are offset from each other in the X direction. Moreover, a position P1B of the second via electrode portion 20B of the first resonator 11A and a position P2B of the second via electrode portion 20B of the second resonator 11B are offset from each other in the X direction. The position P2A of the first via electrode portion 20A of the second resonator 11B and a position P3A of the first via electrode portion 20A of the third resonator 11C are offset from each other in the X direction. Moreover, the position P2B of the second via electrode portion 20B of the second resonator 11B and a position P3B of the second via electrode portion 20B of the third resonator 11C are offset from each other in the X direction. Note that description will be given here assuming positions of centers of the first via electrode portions 20A to be the positions P1A, P2A, P3A of the first via electrode portions 20A. Moreover, description will be given here assuming positions of centers of the second via electrode portions 20B to be the positions P1B, P2B, P3B of the second via electrode portions 20B.

A distance in the X direction between the position P1A of the first via electrode portion 20A of the first resonator 11A and the position P1B of the second via electrode portion 20B of the first resonator 11A will be assumed to be L1X. A distance in the X direction between the position P2A of the first via electrode portion 20A of the second resonator 11B and the position P2B of the second via electrode portion 20B of the second resonator 11B will be assumed to be L2X. A distance in the X direction between the position P3A of the first via electrode portion 20A of the third resonator 11C and the position P3B of the second via electrode portion 20B of the third resonator 11C will be assumed to be L3X. In the present embodiment, the distance L2X is set larger than the distances L1X, L3X.

Thus, in the present embodiment, the positions of the first via electrode portions 20A differ from each other in the X direction, among mutually adjacent resonators 11A to 11C. Moreover, in the present embodiment, the positions of the second via electrode portions 20B differ from each other in the X direction, among the mutually adjacent resonators 11A to 11C. Therefore, due to the present embodiment, a distance between mutually adjacent first via electrode portions 20A can be increased, without a distance in the Y direction between the mutually adjacent resonators 11A to 11C being increased. Moreover, due to the present embodiment, a distance between mutually adjacent second via electrode portions 20B can be increased, without the distance in the Y direction between the mutually adjacent resonators 11A to 11C being increased. Therefore, due to the present embodiment, a coupling degree between the mutually adjacent resonators 11A to 11C can be reduced, without the distance in the Y direction between the mutually adjacent resonators 11A to 11C being increased. Hence, due to the present embodiment, the coupling degree between the mutually adjacent resonators 11A to 11C can be reduced while size of the filter 10 is kept small.

Figure 4B:
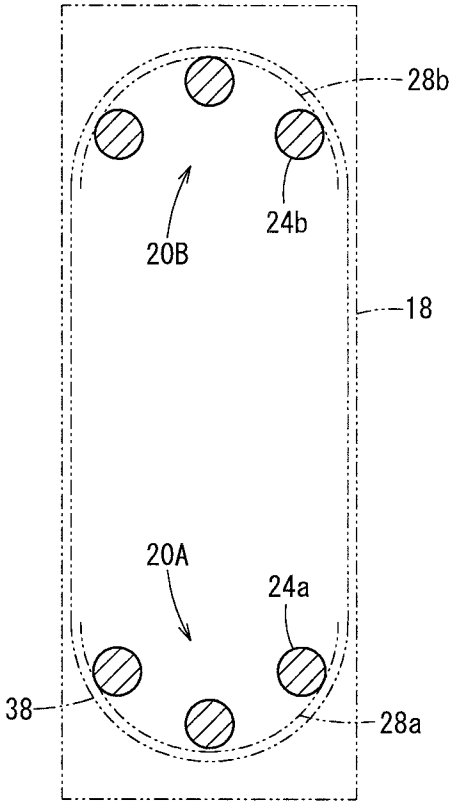
FIGS. 4A and 4B are plan views showing examples of arrangement of via electrodes.
Figure 4A:
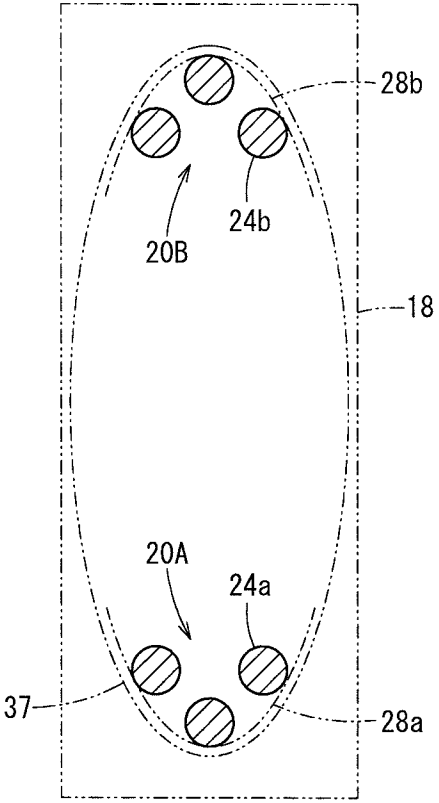

FIGS. 4A and 4B are plan views showing examples of arrangement of the via electrodes. FIG. 4A shows an example where the via electrodes 24*a* and the via electrodes 24*b* are disposed so as to lie along parts of an imaginary elliptical shape (ellipse) 37. FIG. 4B shows an example where the via electrodes 24*a* and the via electrodes 24*b* are disposed so as to lie along parts of an imaginary track shape 38. A track shape refers to a shape configured from two facing semicircular portions and two parallel straight-line portions connecting these semicircular portions.

In the example shown in FIG. 4A, the plurality of via electrodes 24*a* are arranged along an imaginary first curved line 28*a* configuring part of the imaginary elliptical shape 37, when viewed from an upper surface. Moreover, in the example shown in FIG. 4A, the plurality of via electrodes 24*b* are arranged along an imaginary second curved line 28*b* configuring part of the imaginary elliptical shape 37, when viewed from the upper surface. In the example shown in FIG. 4B, the plurality of via electrodes 24*a* are arranged along an imaginary first curved line 28*a* configuring part of the imaginary track shape 38, when viewed from an upper surface. Moreover, in the example shown in FIG. 4B, the plurality of via electrodes 24*b* are arranged along an imaginary second curved line 28*b* configuring part of the imaginary track shape 38, when viewed from the upper surface.

It is for the following reasons that the via electrodes 24*a* and the via electrodes 24*b* are arranged so as to lie along the imaginary elliptical shape 37 or the imaginary track shape 38. That is, in order for a Q-factor of the filter to be improved, it is conceivable for current density in the via electrode portions 20A, 20B to be lowered. In order for current density in the via electrode portions 20A, 20B to be lowered, it is conceivable for diameters of the via electrode portions 20A, 20B to be made larger. However, if the diameters of the via electrode portions 20A, 20B are simply set larger, then a distance between an electric wall occurring between the resonators 11A to 11C, and the resonators 11A to 11C, becomes smaller, hence leading to a deterioration in the Q-factor. In contrast, if the via electrode portions 20A, 20B are configured in the elliptical shape 37, and the resonators 11A to 11C are multi-staged in a short axis direction of the elliptical shape 37, then distances between each other of the via electrode portions 20A, 20B become longer, hence deterioration in the Q-factor can be suppressed. Moreover, if the via electrode portions 20A, 20B are configured in the track shape 38, and the resonators 11A to 11C are multi-staged in a direction perpendicular to a longitudinal direction of the straight-line portions of the track shape 38, then distances between each other of the via electrode portions 20A, 20B become longer, hence deterioration in the Q-factor can be suppressed. It is for such reasons that, in the present embodiment, the via electrodes 24*a* and the via electrodes 24*b* are arranged so as to lie along the imaginary elliptical shape 37 or the imaginary track shape 38.

Moreover, it is for the following reasons that the via electrodes 24*a* and the via electrodes 24*b* are respectively disposed in end portions of the imaginary elliptical shape 37, that is, in both end portions where curvature is large, of the imaginary elliptical shape 37. Moreover, it is for the following reasons that the via electrodes 24*a* and the via electrodes 24*b* are respectively disposed in the semicircular portions of the imaginary track shape 38. That is, a high frequency current concentrates in the end portions of the imaginary elliptical shape 37, that is, in both end portions where curvature is large, of the imaginary elliptical shape 37. Moreover, a high frequency current concentrates in both end portions of the imaginary track shape 38, that is, in the semicircular portions of the imaginary track shape 38. Therefore, even if the via electrodes 24*a*, 24*b* are configured not to be disposed in a portion other than both end portions of the imaginary elliptical shape 37 or the imaginary track shape 38, it will never lead to a significant lowering of the Q-factor. In addition, if the number of via electrodes 24*a*, 24*b* is reduced, a time required for forming the vias can be shortened, hence an improvement in throughput can be achieved. Moreover, if the number of via electrodes 24*a*, 24*b* is reduced, a material such as silver embedded in the vias may be reduced, hence a reduction in costs can also be achieved. Moreover, since a region where an electromagnetic field is comparatively sparse is formed between the first via electrode portion 20A and the second via electrode portion 20B, it is possible too for a strip line for coupling adjustment, and so on, to be formed in the region. It is from such viewpoints that, in the present embodiment, the via electrodes 24*a* and the via electrodes 24*b* are disposed in both end portions of the imaginary elliptical shape 37 or the imaginary track shape 38.

The via electrode portions 20A, 20B and the first side surface shielding conductor 12Ca and second side surface shielding conductor 12Cb behave like a semi-coaxial resonator. Orientation of current flowing in the via electrode portions 20A, 20B and orientation of current flowing in the first side surface shielding conductor 12Ca are opposite, and moreover, orientation of current flowing in the via electrode portions 20A, 20B and orientation of current flowing in the second side surface shielding conductor 12Cb are opposite. Therefore, an electromagnetic field can be confined in a portion surrounded by the shielding conductors 12A, 12B, 12Ca, 12Cb, and loss due to radiation can be reduced and effects on outside reduced. At a certain timing during resonance, current flows so as to diffuse from a center of the upper shielding conductor 12A to an entire surface of the upper shielding conductor 12A. At this time, current flows in the lower shielding conductor 12B so as to concentrate from an entire surface of the lower shielding conductor 12B toward a center of the lower shielding conductor 12B. Moreover, at another timing during resonance, current flows so as to diffuse from the center of the lower shielding conductor 12B to the entire surface of the lower shielding conductor 12B. At this time, current flows in the upper shielding conductor 12A so as to concentrate from the entire surface of the upper shielding conductor 12A toward the center of the upper shielding conductor 12A. The current flowing so as to diffuse to the entire surface of the upper shielding conductor 12A or lower shielding conductor 12B similarly flows, as is, in the first side surface shielding conductor 12Ca and second side surface shielding conductor 12Cb too. That is, the current flows in a conductor of broad line width. In a conductor of broad line width, a resistance component is small, and hence deterioration in Q-factor is small. The first via electrode portion 20A and the second via electrode portion 20B realize a TEM wave resonator in conjunction with the shielding conductors 12A, 12B, 12Ca, 12Cb. That is, the first via electrode portion 20A and the second via electrode portion 20B realize a TEM wave resonator with reference to the shielding conductors 12A, 12B, 12Ca, 12Cb. The strip line 18 plays a role of forming open end capacitance. Each of the resonators 11A to 11C provided in the filter 10 may operate as a λ/4 resonator.

Thus, in the present embodiment, positions of the first via electrode portions 20A differ from each other in the X direction, among the mutually adjacent resonators 11A to 11C. Moreover, in the present embodiment, positions of the second via electrode portions 20B differ from each other in the X direction, among the mutually adjacent resonators 11A to 11C. Therefore, due to the present embodiment, the distance between the first via electrode portions 20A can be increased, without the distance in the Y direction between the mutually adjacent resonators 11A to 11C being increased. Moreover, due to the present embodiment, the distance between the second via electrode portions 20B can be increased, without the distance in the Y direction between the mutually adjacent resonators 11A to 11C being increased. Therefore, due to the present embodiment, the coupling degree between the mutually adjacent resonators 11A to 11C can be reduced, without the distance in the Y direction between the mutually adjacent resonators 11A to 11C being increased. Hence, due to the present embodiment, the coupling degree between the mutually adjacent resonators 11A to 11C can be reduced while size of the filter 10 is kept small.

Modified Example 1

Figure 5:
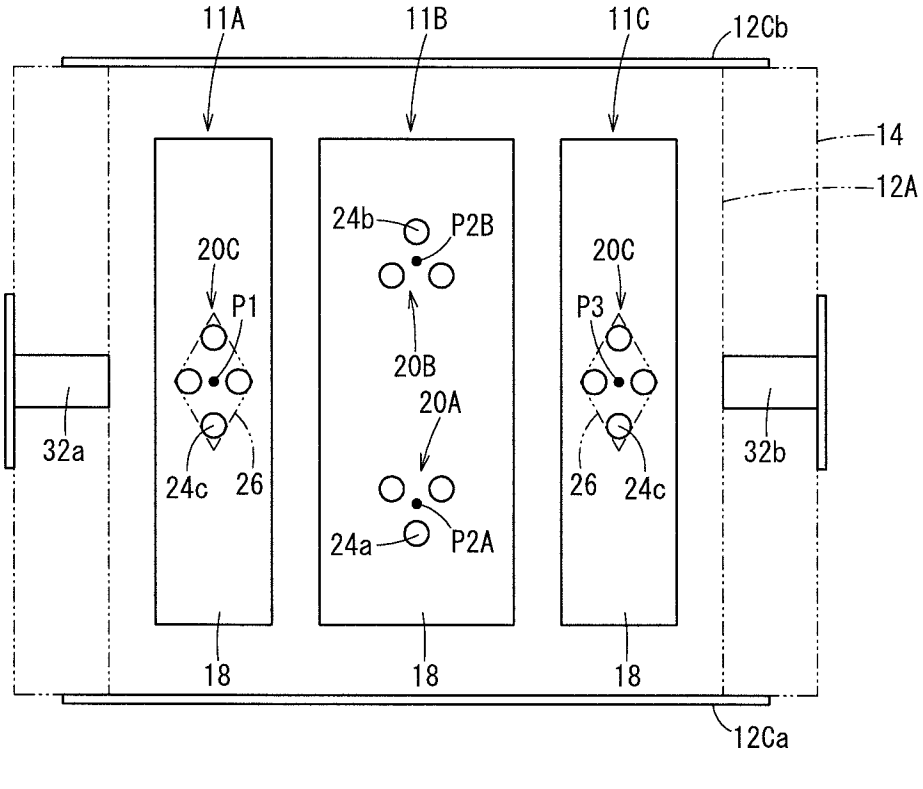
FIG. 5 is a plan view showing a filter according to modified example 1 of the first embodiment.

A filter according to modified example 1 of the present embodiment will be described using FIG. 5. FIG. 5 is a plan view showing the filter according to the present modified example.

As shown in FIG. 5, in the present modified example, the first resonator 11A is provided with one via electrode portion (a third via electrode portion) 20C. The via electrode portion 20C of the first resonator 11A is configured from a plurality of via electrodes 24*c*. The via electrodes 24*c* are embedded in via holes formed in the dielectric substrate 14. The one via electrode portion 20C is configured by four via electrodes 24*c*. The four via electrodes 24*c* configuring the one via electrode portion 20C are positioned at vertices of an imaginary rhombus 26. The via electrode portion 20C of the first resonator 11A is connected to the strip line 18 of the first resonator 11A at a center in the X direction of the strip line 18.

The via electrode portion of the second resonator 11B is provided with two via electrode portions, that is, the first via electrode portion 20A and the second via electrode portion 20B. The first via electrode portion 20A of the second resonator 11B is positioned on a side surface 14*c* side of the dielectric substrate 14. The second via electrode portion 20B of the second resonator 11B is positioned on a side surface 14*d* side of the dielectric substrate 14.

The via electrode portion 20C of the third resonator 11C is provided with one via electrode portion (the third via electrode portion) 20C. The via electrode portion 20C of the third resonator 11C is connected to the strip line 18 of the third resonator 11C at a center in the X direction of the strip line 18. Note that although there has been described here as an example the case where one via electrode portion 20C is configured by four via electrodes 24*c*, the present modified example is not limited to this.

The positions P2A, P2B of the via electrode portions 20A, 20B of the second resonator 11B, and a position P1 of the via electrode portion 20C of the first resonator 11A differ in the X direction. A position P3 of the via electrode portion 20C of the third resonator 11C, and the positions P2A, P2B of the via electrode portions 20A, 20B of the second resonator 11B differ in the X direction. Note that description will be given here assuming a position of a center of the via electrode portion 20C of the first resonator 11A to be the position P1 of the via electrode portion 20C. Moreover, description will be given here assuming a position of a center of the via electrode portion 20C of the third resonator 11C to be the position P3 of the via electrode portion 20C. A position of the via electrode portion 20C of the first resonator 11A, that is, the position P1 is at a center of the strip line 18 of the first resonator 11A. A position of a center of the via electrode portion 20C of the third resonator 11C, that is, the position P3 is at a center of the strip line 18 of the third resonator 11C.

Thus, in the present modified example, positions of the via electrode portions 20A, 20B and positions of the via electrode portions 20C are offset from each other in the X direction, among the mutually adjacent resonators 11A to 11C. Therefore, due to the present modified example, a distance between the via electrode portions 20A, 20B and the via electrode portions 20C can be increased, without the distance in the Y direction between the mutually adjacent resonators 11A to 11C being increased. Therefore, due to the present modified example too, the coupling degree between the mutually adjacent resonators 11A to 11C can be reduced, without the distance in the Y direction between the mutually adjacent resonators 11A to 11C being increased. Hence, due to the present modified example too, the coupling degree between the mutually adjacent resonators 11A to 11C can be reduced while size of the filter 10 is kept small.

Modified Example 2

Figure 6:
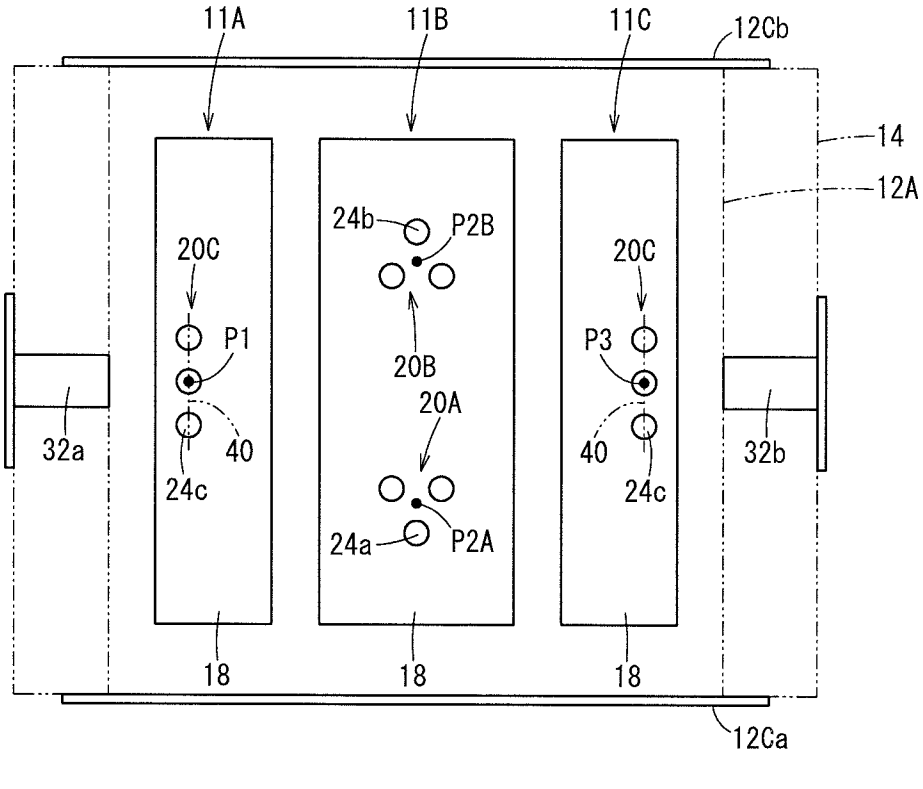
FIG. 6 is a plan view showing a filter according to modified example 2 of the first embodiment.

A filter according to modified example 2 of the present embodiment will be described using FIG. 6. FIG. 6 is a plan view showing the filter according to the present modified example.

The present modified example is one in which the via electrodes 24*c* configuring the via electrode portions 20C are arranged in a straight line in the X direction, and the via electrode portions 20C are positioned closer to side surfaces 14*a*, 14*b* than centers in the Y direction of the strip lines 18 are.

As shown in FIG. 6, in the present modified example, the first resonator 11A is provided with one via electrode portion 20C. The via electrodes 24*c* configuring the via electrode portion 20C of the first resonator 11A are arranged in the X direction along an imaginary straight line 40. The via electrode portion 20C of the first resonator 11A is configured by three via electrodes 24*c*. The via electrode portion 20C of the first resonator 11A is connected to the strip line 18 of the first resonator 11A at the center in the X direction of the strip line 18. The via electrode portion 20C of the first resonator 11A is positioned closer to the side surface 14*a* than the center in the Y direction of the strip line 18 is.

The second resonator 11B is provided with two via electrode portions, that is, the first via electrode portion 20A and the second via electrode portion 20B. The first via electrode portion 20A of the second resonator 11B is positioned on the side surface 14*c* side. The second via electrode portion 20B of the second resonator 11B is positioned on the side surface 14*d* side.

The third resonator 11C is configured by one via electrode portion 20C. The via electrodes 24*c* configuring the via electrode portion 20C of the third resonator 11C are arranged in the X direction along an imaginary straight line 40. The via electrode portion 20C of the third resonator 11C is configured by three via electrodes 24*c*. The via electrode portion 20C of the third resonator 11C is connected to the strip line 18 of the third resonator 11C at the center in the X direction of the strip line 18. The via electrode portion 20C of the third resonator 11C is positioned closer to the side surface 14*b* than the center in the Y direction of the strip line 18 is.

Note that although there has been described here as an example the case where one via electrode portion 20C is configured by three via electrodes 24*c*, the present modified example is not limited to this.

The positions P2A, P2B of the via electrode portions 20A, 20B of the second resonator 11B, and the positions P1, P3 of the via electrode portions 20C of the resonators 11A, 11C are offset in the X direction. Moreover, in the present modified example, the via electrode portions 20C of the resonators 11A, 11C are respectively positioned closer to the side surfaces 14*a*, 14*b* than centers in the Y direction of the strip lines 18 are. Therefore, due to the present modified example, the distance between the via electrode portions 20A, 20B and the via electrode portions 20C can be increased, without the distance in the Y direction between the mutually adjacent resonators 11A to 11C being increased. Therefore, due to the present modified example, the coupling degree between the mutually adjacent resonators 11A to 11C can be reduced, without the distance in the Y direction between the mutually adjacent resonators 11A to 11C being increased. Hence, due to the present modified example, the coupling degree between the mutually adjacent resonators 11A to 11C can be reduced while size of the filter 10 is kept small.

Moreover, due to the present modified example, the via electrode portions 20C of the resonators 11A, 11C are positioned closer to the side surfaces 14*a*, 14*b* than centers in the Y direction of the strip lines 18 are. Therefore, due to the present modified example, a distance between the via electrode portions 20C of the resonators 11A, 11C and the input/output terminals 22A, 22B can be reduced. Therefore, due to the present modified example, a coupling degree between the via electrode portions 20C of the resonators 11A, 11C and the input/output terminals 22A, 22B can be increased.

Modified Example 3

Figure 7:
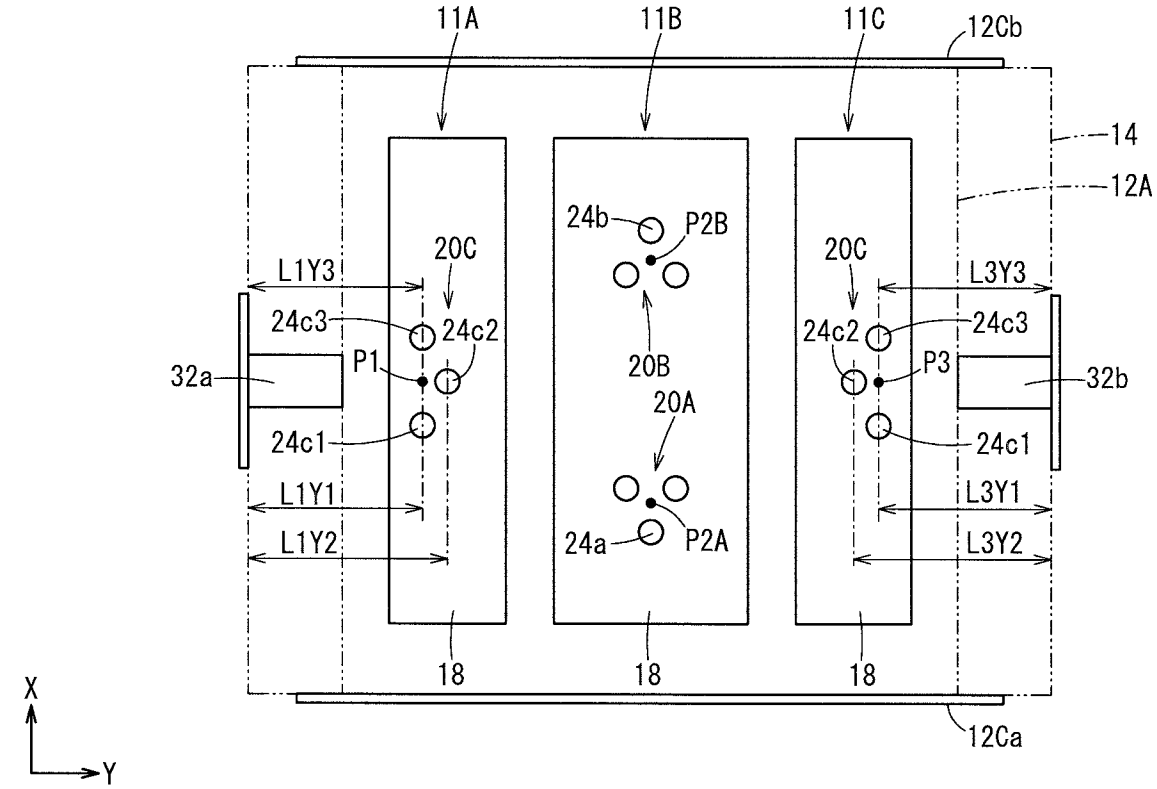
FIG. 7 is a plan view showing a filter according to modified example 3 of the first embodiment.

A filter according to modified example 3 of the present embodiment will be described using FIG. 7. FIG. 7 is a plan view showing the filter according to the present modified example.

As shown in FIG. 7, in the present modified example, the via electrode portion 20C of the first resonator 11A is configured by a plurality of via electrodes 24*c*1 to 24*c*3. The via electrode (a first via electrode) 24*c*1 of the first resonator 11A is positioned on the side surface 14*c* side of the via electrode (a second via electrode) 24*c*2 of the first resonator 11A. The via electrode (a third via electrode) 24*c*3 of the first resonator 11A is positioned on the side surface 14*d* side of the via electrode 24*c*2 of the first resonator 11A. The via electrode 24*c*2 of the first resonator 11A is positioned at the center in the X direction of the strip line 18 of the first resonator 11A. The via electrode portion 20C of the first resonator 11A is positioned closer to the side surface 14*a* than the center in the Y direction of the strip line 18 is. A distance L1Y2 between the via electrode 24*c*2 of the first resonator 11A and the side surface 14*a* is larger than a distance L1Y1 between the via electrode 24*c*1 of the first resonator 11A and the side surface 14*a*. Moreover, the distance L1Y2 between the via electrode 24*c*2 of the first resonator 11A and the side surface 14*a* is larger than a distance L1Y3 between the via electrode 24*c*3 of the first resonator 11A and the side surface 14*a*.

The second resonator 11B is provided with two via electrode portions, that is, the first via electrode portion 20A and the second via electrode portion 20B. The first via electrode portion 20A of the second resonator 11B is positioned on the side surface 14*c* side. The second via electrode portion 20B of the second resonator 11B is positioned on the side surface 14*d* side.

The via electrode portion 20C of the third resonator 11C is configured by a plurality of via electrodes 24*c*1 to 24*c*3. The via electrode (a first via electrode) 24*c*1 of the third resonator 11C is positioned on the side surface 14*c* side of the via electrode (a second via electrode) 24*c*2 of the third resonator 11C. The via electrode (a third via electrode) 24*c*3 of the third resonator 11C is positioned on the side surface 14*d* side of the via electrode 24*c*2 of the third resonator 11C. The via electrode 24*c*2 of the third resonator 11C is positioned at the center in the X direction of the strip line 18 of the third resonator 11C. The via electrode portion 20C of the third resonator 11C is positioned closer to the side surface 14*b* than the center in the Y direction of the strip line 18 is. A distance L3Y2 between the via electrode 24*c*2 of the third resonator 110 and the side surface 14*b* is larger than a distance L3Y1 between the via electrode 24*c*1 of the third resonator 11C and the side surface 14*b*. Moreover, the distance L3Y2 between the via electrode 24*c*2 of the third resonator 11C and the side surface 14*b* is larger than a distance L3Y3 between the via electrode 24*c*3 of the third resonator 11C and the side surface 14*b*.

Note that although there has been described here as an example the case where one via electrode portion 20C is configured by three via electrodes 24*c*, the present modified example is not limited to this.

In the present modified example, the distances between the via electrodes 24*c*2 of the resonators 11A, 11C and the side surfaces 14*a*, 14*b* are larger than the distances between the via electrodes 24*c*1, 24*c*3 of the resonators 11A, 11C and the side surfaces 14*a*, 14*b*. Therefore, due to the present modified example, apparent cross-sectional areas of the via electrode portions 20C can be increased while the coupling degree between the via electrode portions 20C and the via electrode portions 20A, 20B is maintained small. Since the apparent cross-sectional areas of the via electrode portions 20C can be increased, the present modified example enables an improvement in the Q-factor to be achieved.

Moreover, in the present modified example, the distances between the via electrodes 24*c*2 of the resonators 11A, 11C and the side surfaces 14*a*, 14*b* are larger than the distances between the via electrodes 24*c*1, 24*c*3 of the resonators 11A, 11C and the side surfaces 14*a*, 14*b*. Therefore, the present modified example makes it possible that, at the same time as the coupling degree between the via electrode portions 20C and the input/output terminals 22A, 22B is adjusted, coupling between the resonators 11A to 11C is adjusted too.

Modified Example 4

A filter according to modified example 4 of the present embodiment will be described using FIGS. 8A and 8B.

Figure 8A:
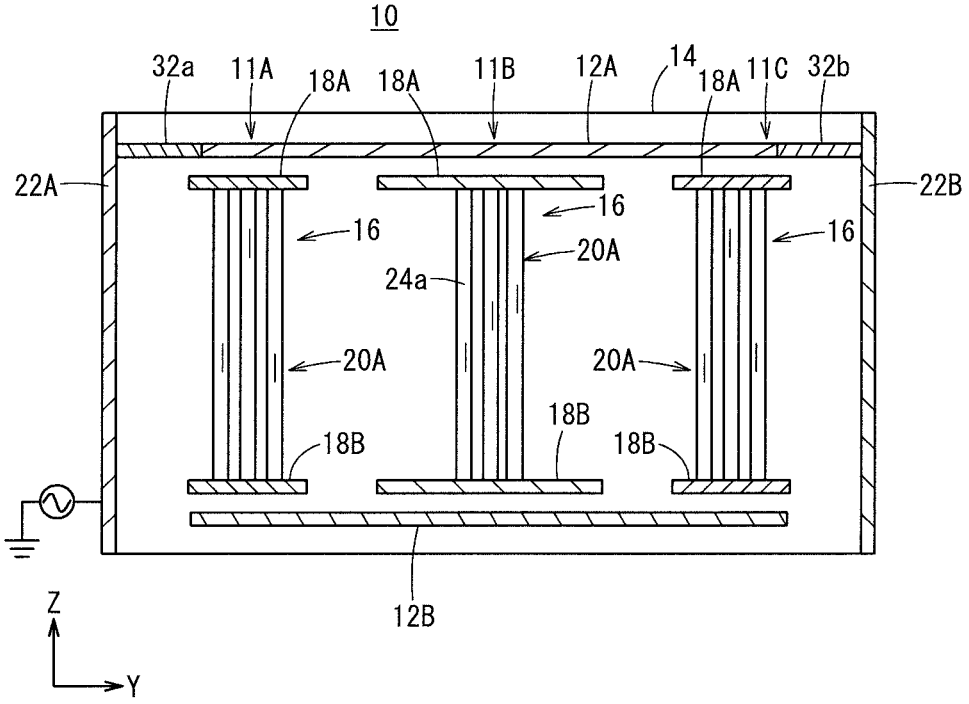
FIGS. 8A and 8B are cross-sectional views showing a filter according to modified example 4 of the first embodiment.
Figure 8B:
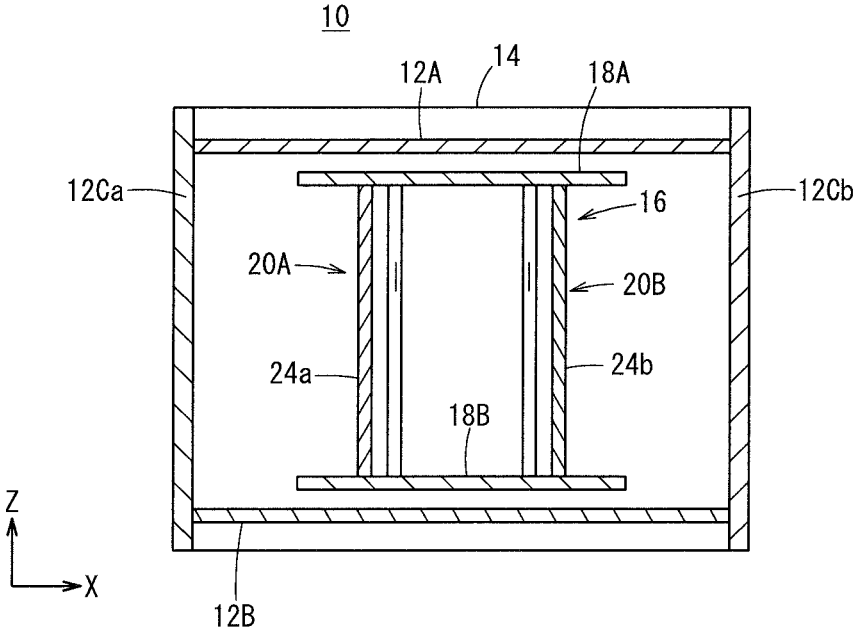

FIGS. 8A and 8B are cross-sectional views showing the filter according to the present modified example.

The present modified example is one in which the dielectric substrate 14 has formed therein: an upper strip line (a second strip line) 18A that faces the upper shielding conductor 12A; and a lower strip line (a first strip line) 18B that faces the lower shielding conductor 12B.

In the present modified example, one end of the via electrode portion 20A and one end of the via electrode portion 20B are connected to the upper strip line 18A, and the other ends of the via electrode portions 20A, 20B are connected to the lower strip line 18B. Thus, the via electrode portions 20A, 20B are formed from the upper strip line 18A to the lower strip line 18B. The via electrode portions 20A, 20B and the strip lines 18A, 18B configure the structure 16.

The via electrode portions 20A, 20B and the first side surface shielding conductor 12Ca and second side surface shielding conductor 12Cb behave like a semi-coaxial resonator, similarly to in the case of the filter 10 shown in FIG. 1.

In the present modified example, the via electrode portions 20A, 20B are not electrically continuous with either the upper shielding conductor 12A or the lower shielding conductor 12B. Electrostatic capacitance (open end capacitance) exists between the upper strip line 18A connected to the via electrode portions 20A, 20B, and the upper shielding conductor 12A. Moreover, electrostatic capacitance exists also between the lower strip line 18B connected to the via electrode portions 20A, 20B, and the lower shielding conductor 12B. The via electrode portions 20A, 20B configure a $\lambda/2$ resonator in conjunction with the upper strip line 18A and the lower strip line 18B.

In the $\lambda/4$ resonator like that shown in FIG. 1, current concentrates in portions where the via electrode portions 20A, 20B and the shielding conductor 12A are contacting each other, that is, in short-circuit portions, during resonance. Portions where the via electrode portions 20A, 20B and the shielding conductor 12A are contacting each other are portions where a path of the current bends perpendicularly. Concentration of current in a place where the path of the current bends greatly may cause a lowering of the Q-factor. In order to eliminate concentration of current in the short-circuit portions and thereby improve the Q-factor, it is conceivable too for cross-sectional area of the current path to be made larger. For example, it is conceivable for a via diameter to be made larger or for the number of vias to be increased. However, in the case of doing so, size of the resonator ends up increasing, and a requirement of downsizing of the resonator cannot be fulfilled. In contrast, in the present modified example, the via electrode portions 20A, 20B do not contact either the upper shielding conductor 12A or the lower shielding conductor 12B. That is, in the present modified example, a both end-opened type $\lambda/2$ resonator is configured. Therefore, in the present modified example, a local concentration of current is prevented from occurring in the upper shielding conductor 12A and the lower shielding conductor 12B, and meanwhile, current can be concentrated in vicinities of centers of the via electrode portions 20A, 20B. Since it is the via electrode portions 20A, 20B alone where current concentrates, that is, since current concentrates where there is continuity (linearity), the present modified example enables the Q-factor to be improved.

Second Embodiment

Figure 9:
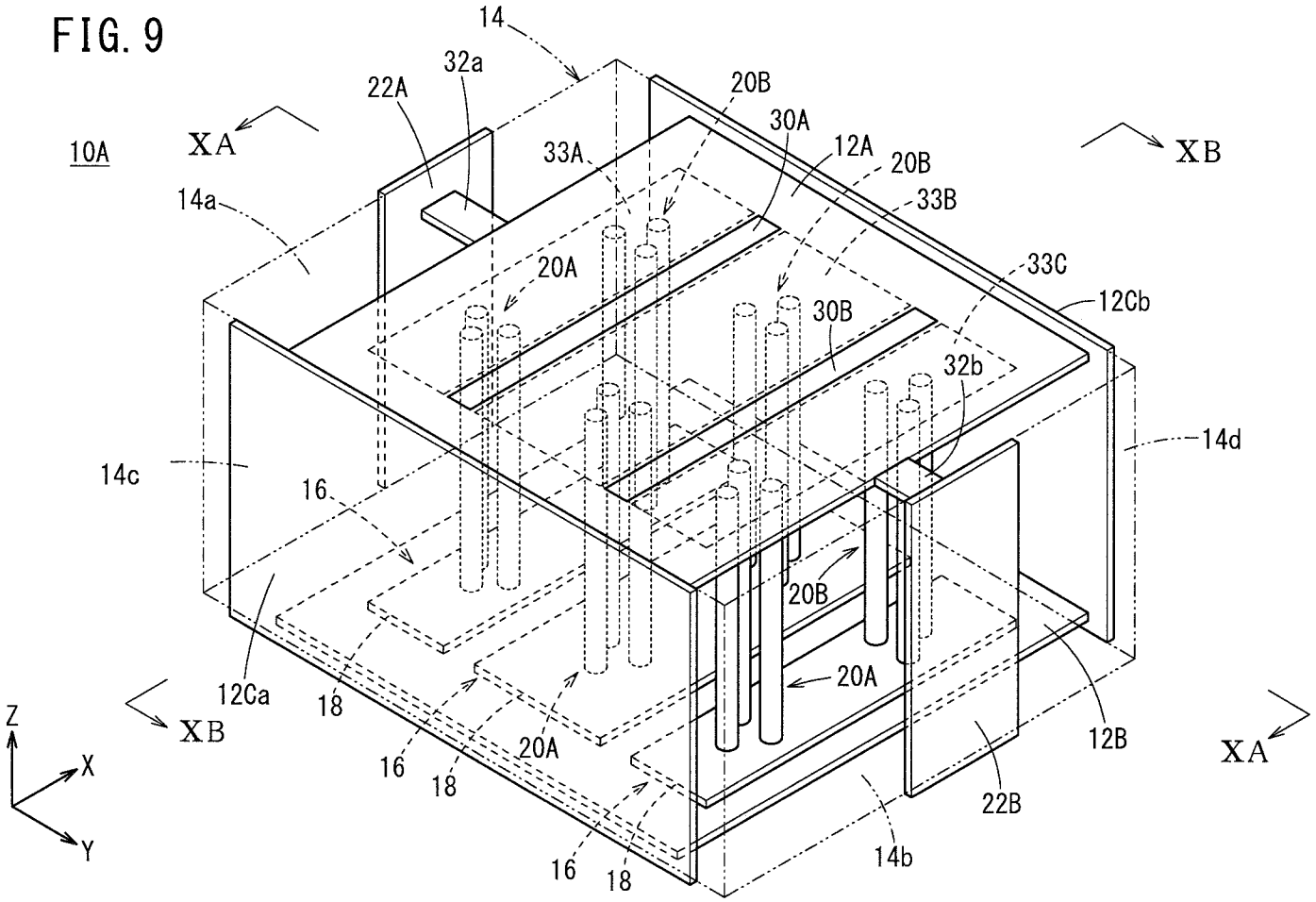
FIG. 9 is a perspective view showing a filter according to a second embodiment.
Figure 10A:
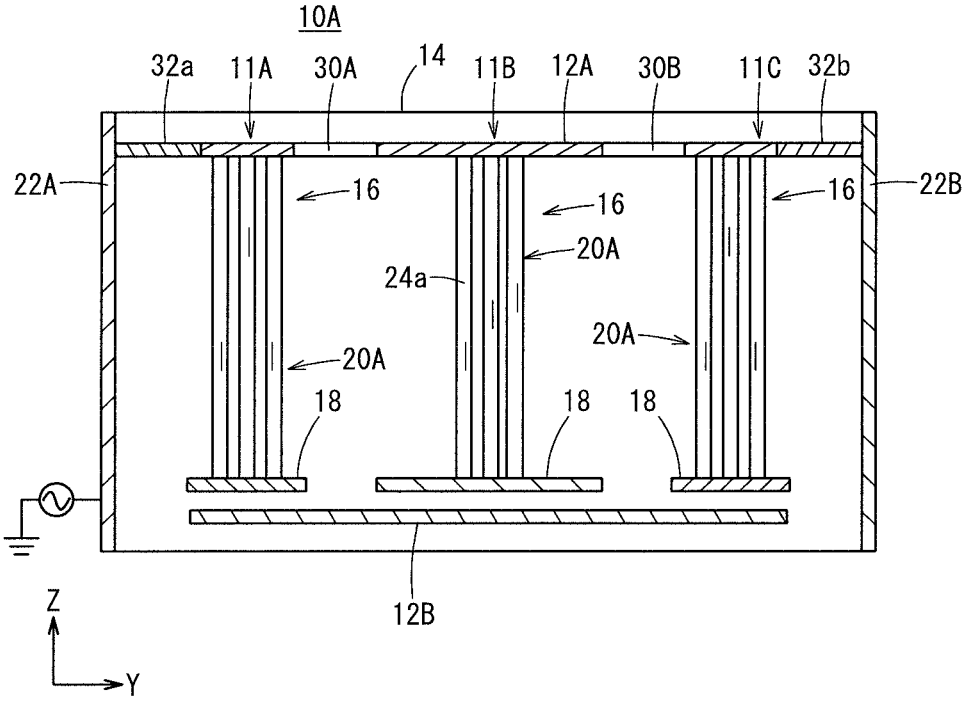
FIGS. 10A and 10B are cross-sectional views showing the filter according to the second embodiment.
Figure 10B:
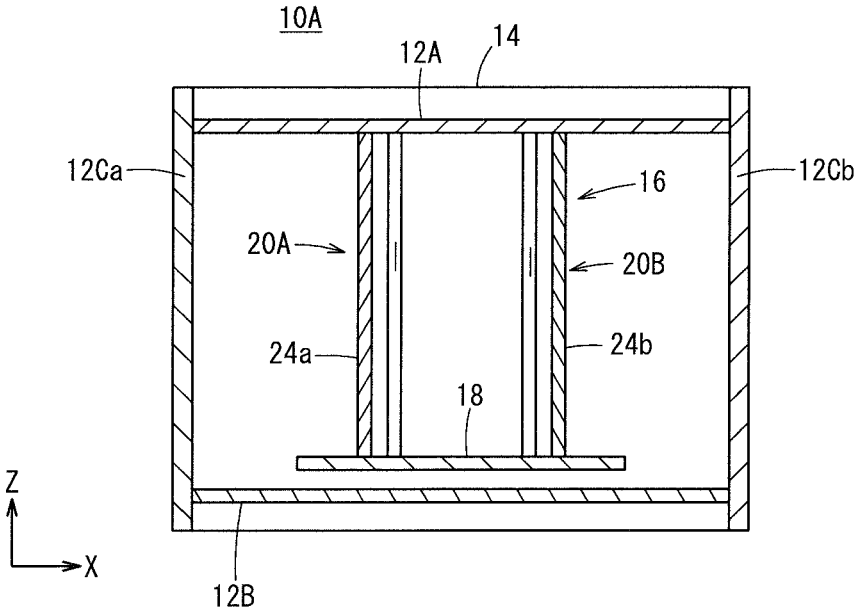
Figure 11:
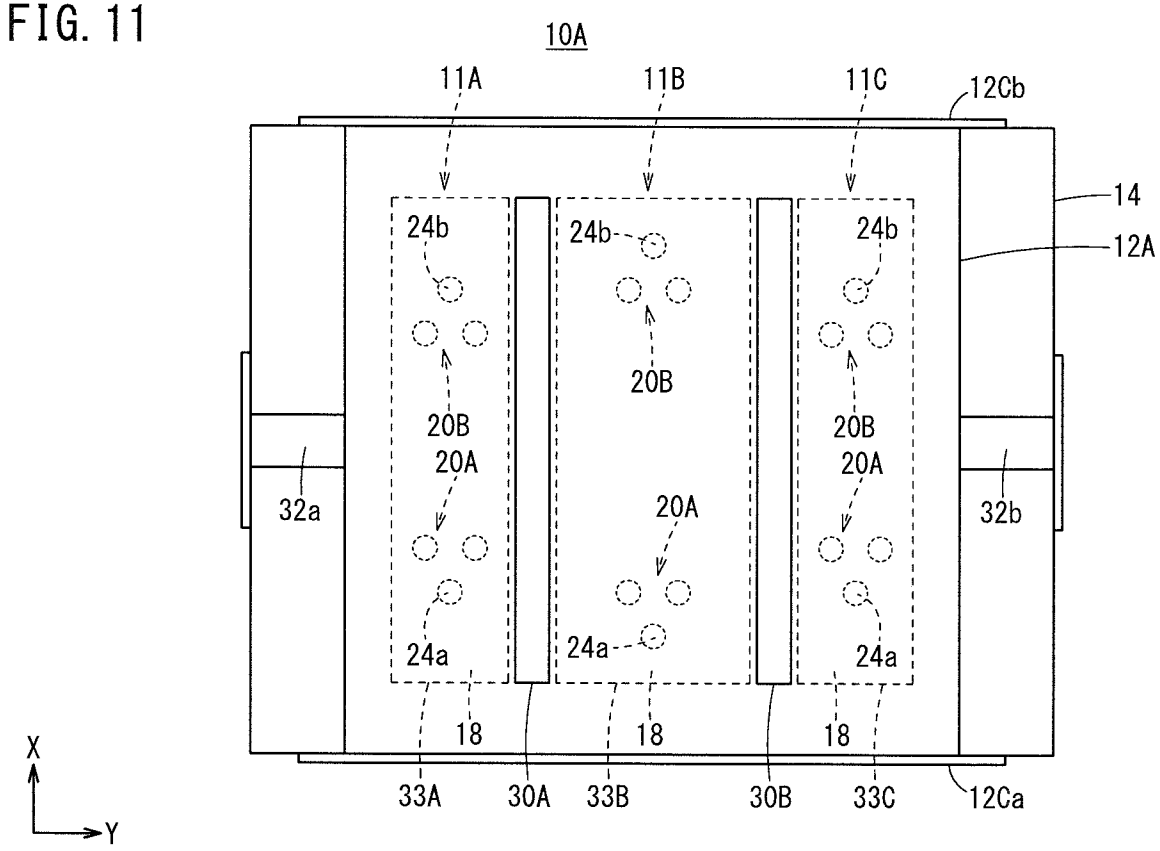
FIG. 11 is a plan view showing the filter according to the second embodiment.

A filter according to a second embodiment will be described using the drawings. FIG. 9 is a perspective view showing the filter according to the present embodiment. FIGS. 10A and 10B are cross-sectional views showing the filter according to the present embodiment. FIG. 10A corresponds to the line XA-XA of FIG. 9. FIG. 10B corresponds to the line XB-XB of FIG. 9. FIG. 11 is a plan view showing the filter according to the present embodiment. Configuring elements similar to in the filter according to the first embodiment will be assigned with the same symbols as in the first embodiment, and descriptions thereof will be omitted or simplified.

A filter 10A according to the present embodiment is one in which slits 30A, 30B are formed in the upper shielding conductor 12A. The slit 30A is positioned between a first portion 33A of the upper shielding conductor 12A overlapping in planar view at least the via electrode portions 20A, 20B of the resonator 11A, and a second portion 33B of the upper shielding conductor 12A overlapping in planar view at least the via electrode portions 20A, 20B of the resonator 11B. The slit 30B is positioned between the second portion 33B of the upper shielding conductor 12A overlapping in planar view at least the via electrode portions 20A, 20B of the resonator 11B, and a third portion 33C of the upper shielding conductor 12A overlapping in planar view at least the via electrode portions 20A, 20B of the resonator 11C. Note that although there is illustrated here the case where the first portion 33A of the upper shielding conductor 12A and the strip line 18 of the resonator 11A are overlapping each other, the present embodiment is not limited to this. Moreover, although there is illustrated here the case where the second portion 33B of the upper shielding conductor 12A and the strip line 18 of the resonator 11B are overlapping each other, the present embodiment is not limited to this. Moreover, although there is illustrated here the case where the third portion 33C of the upper shielding conductor 12A and the strip line 18 of the resonator 11C are overlapping each other, the present embodiment is not limited to this. In addition, although there is illustrated here the case where the slit 30A is formed so as not to overlap in planar view either the strip line 18 of the resonator 11A or the strip line 18 of the resonator 11B, the present embodiment is not limited to this. At least either of the strip line 18 of the resonator 11A and the strip line 18 of the resonator 11B may be overlapped in planar view by part of the slit 30A. Moreover, although there is illustrated here the case where the slit 30B is formed so as not to overlap in planar view either the strip line 18 of the resonator 11B or the strip line 18 of the resonator 11C, the present embodiment is not limited to this. At least either of the strip line 18 of the resonator 11B and the strip line 18 of the resonator 11C may be overlapped in planar view by part of the slit 30B. It is adequate that a configuration is adapted whereby the slit 30A is formed at least between the via electrode portion 20A of the resonator 11A and the via electrode portion 20A of the resonator 11B, and between the via electrode portion 20B of the resonator 11A and the via electrode portion 20B of the resonator 11B. Moreover, it is adequate that a configuration is adopted whereby the slit 30B is formed at least between the via electrode portion 20A of the resonator 11B and the via electrode portion 20A of the resonator 11C, and between the via electrode portion 20B of the resonator 11B and the via electrode portion 20B of the resonator 11C.

The present embodiment enables the coupling degree between the resonator 11A and the resonator 11B to be reduced due to such a slit 30A being formed in the upper shielding conductor 12A. Moreover, the present embodiment enables the coupling degree between the resonator 11B and the resonator 11C to be reduced due to such a slit 30B being formed in the upper shielding conductor 12A. Therefore, due to the present embodiment, the coupling degree between the mutually adjacent resonators 11A to 11C can be reduced, without the distance in the Y direction between the mutually adjacent resonators 11A to 11C being increased. Hence, due to the present embodiment, the coupling degree between the mutually adjacent resonators 11A to 11C can be reduced while size of the filter 10A is kept small.

Modified Example 1

Figure 12:
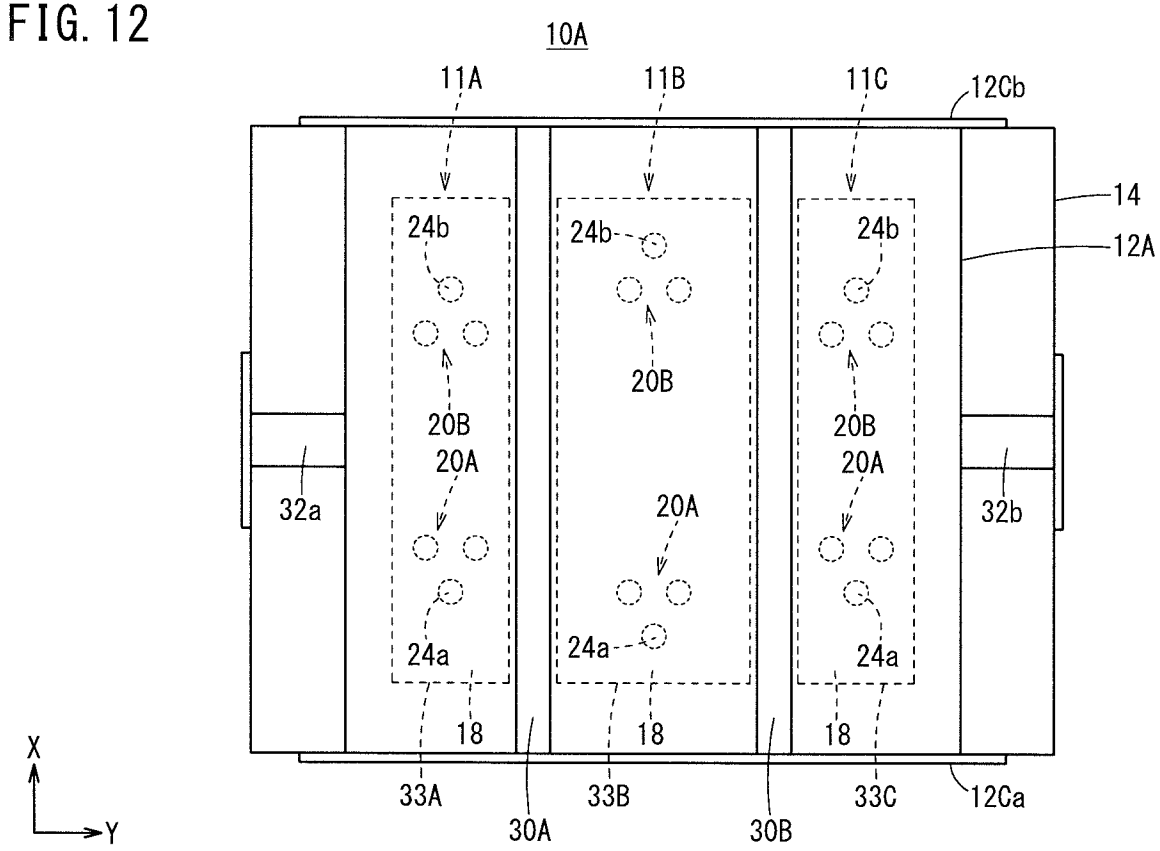
FIG. 12 is a plan view showing a filter according to modified example 1 of the second embodiment.

A filter according to modified example 1 of the present embodiment will be described using FIG. 12. FIG. 12 is a plan view showing the filter according to the present modified example.

The present modified example is one in which the upper shielding conductor 12A is separated by the slits 30A, 30B. That is, in the present modified example, a portion including the first portion 33A of the upper shielding conductor 12A and a portion including the second portion 33B of the upper shielding conductor 12A are separated by the slit 30A. Moreover, in the present modified example, the portion including the second portion 33B of the upper shielding conductor 12A and a portion including the third portion 33C of the upper shielding conductor 12A are separated by the slit 30B.

In this way, the upper shielding conductor 12A may be separated by the slits 30A, 30B. In the case of the slits 30A, 30B being thus formed too, the coupling degree between the mutually adjacent resonators 11A to 11C can be reduced while size of the filter 10A is kept small.

Modified Example 2

Figure 13A:
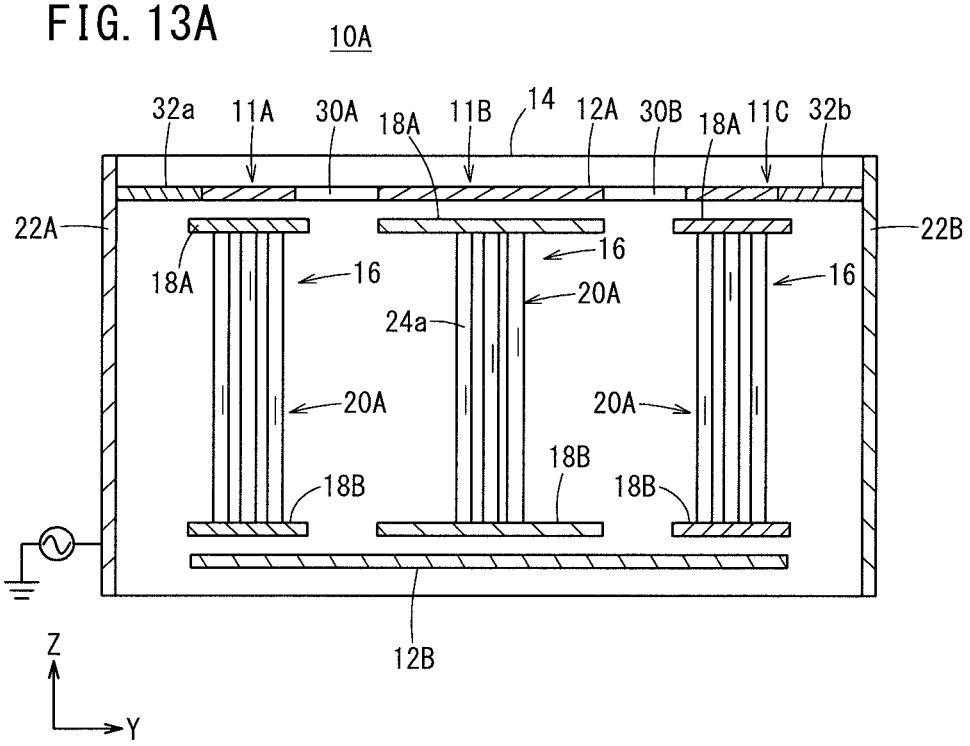
FIGS. 13A and 13B are cross-sectional views showing a filter according to modified example 2 of the second embodiment.
Figure 13B:
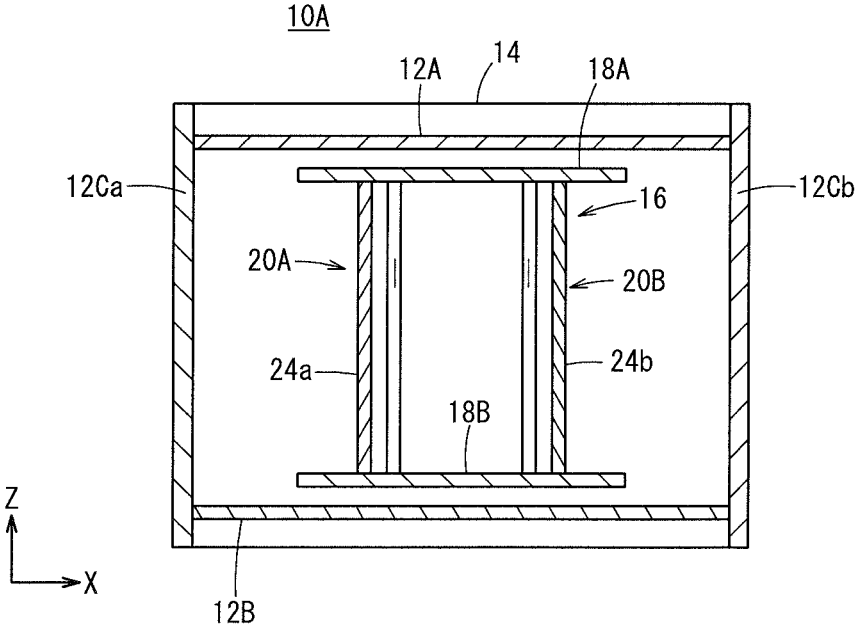

A filter according to modified example 2 of the present embodiment will be described using FIGS. 13A and 13B. FIGS. 13A and 13B are cross-sectional views showing the filter according to the present modified example.

The present modified example is one in which the dielectric substrate 14 has formed therein: the upper strip line 18A that faces the upper shielding conductor 12A; and the lower strip line 18B that faces the lower shielding conductor 12B. At least either of the upper strip line 18A of the resonator 11A and the upper strip line 18A of the resonator 11B may be overlapped in planar view by part of the slit 30A, but need not be overlapped in planar view by part of the slit 30A. At least either of the upper strip line 18A of the resonator 11B and the upper strip line 18A of the resonator 11C may be overlapped in planar view by part of the slit 30B, but need not be overlapped in planar view by part of the slit 30B. It is adequate that a configuration is adopted whereby the slit 30A is formed at least between the via electrode portion 20A of the resonator 11A and the via electrode portion 20A of the resonator 11B, and between the via electrode portion 20B of the resonator 11A and the via electrode portion 20B of the resonator 11B. Moreover, it is adequate that a configuration is adopted whereby the slit 30B is formed at least between the via electrode portion 20A of the resonator 11B and the via electrode portion 20A of the resonator 11C, and between the via electrode portion 20B of the resonator 11B and the via electrode portion 20B of the resonator 11C.

Due to the present modified example, the via electrode portions 20A, 20B do not contact either the upper shielding conductor 12A or the lower shielding conductor 12B. Therefore, in the present modified example, a local concentration of current is prevented from occurring in the upper shielding conductor 12A and the lower shielding conductor 12B, and meanwhile, current can be concentrated in vicinities of centers of the via electrode portions 20A, 20B. Since it is the via electrode portions 20A, 20B alone where current concentrates, that is, since current concentrates where there is continuity (linearity), the present modified example enables the Q-factor to be improved.

Third Embodiment

Figure 14:
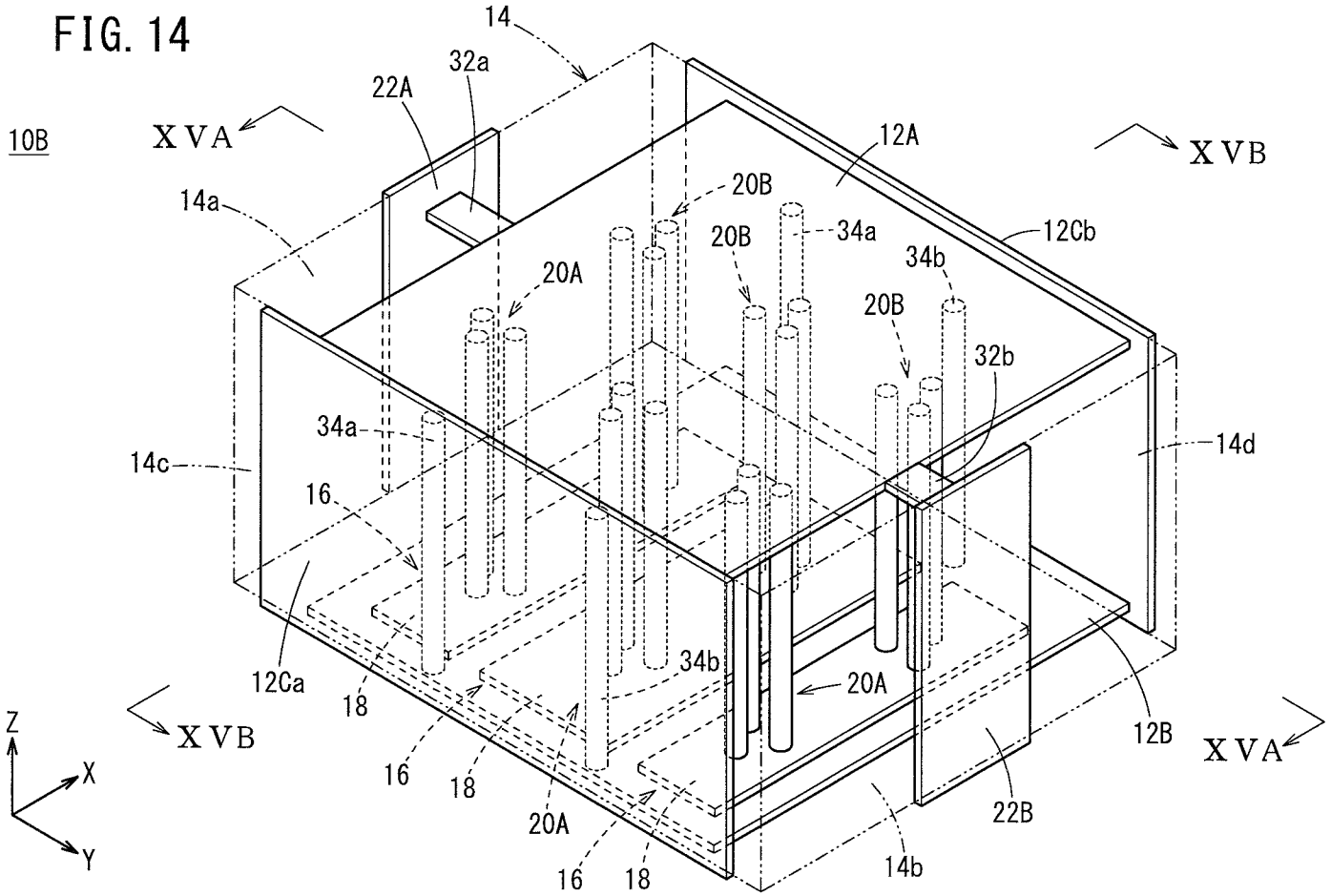
FIG. 14 is a perspective view showing a filter according to a third embodiment.
Figure 15A:
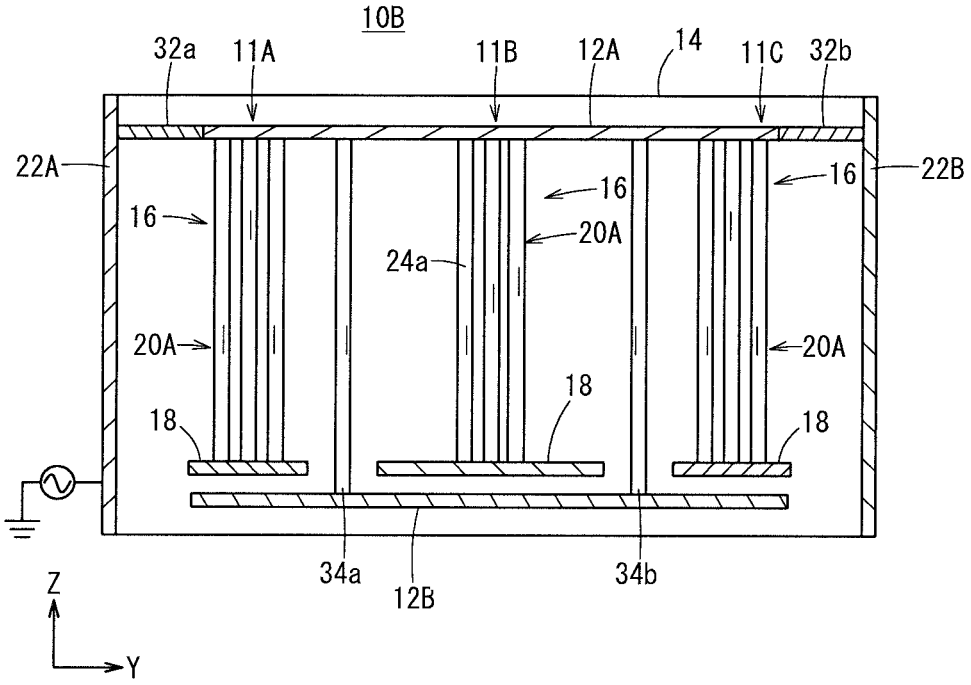
FIGS. 15A and 15B are cross-sectional views showing the filter according to the third embodiment.
Figure 15B:
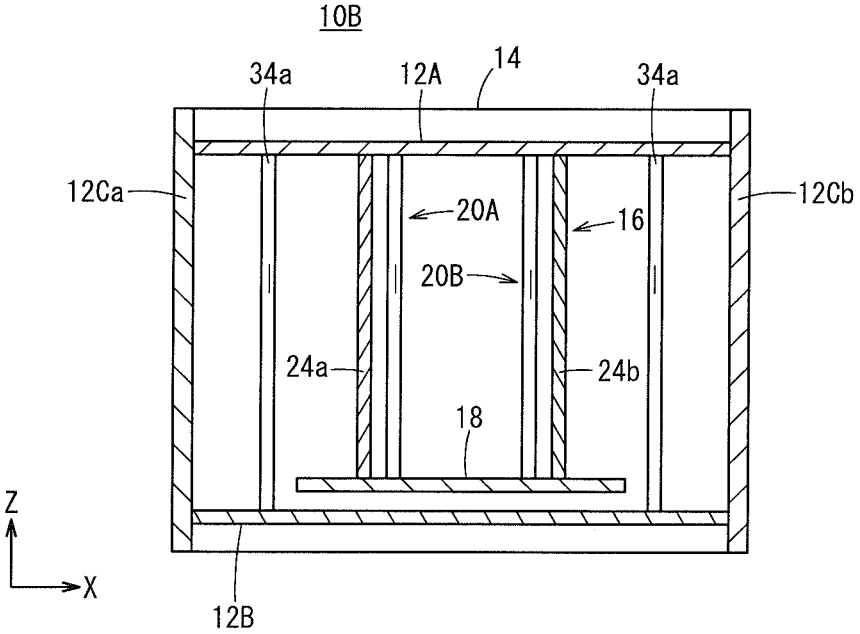
Figure 16:
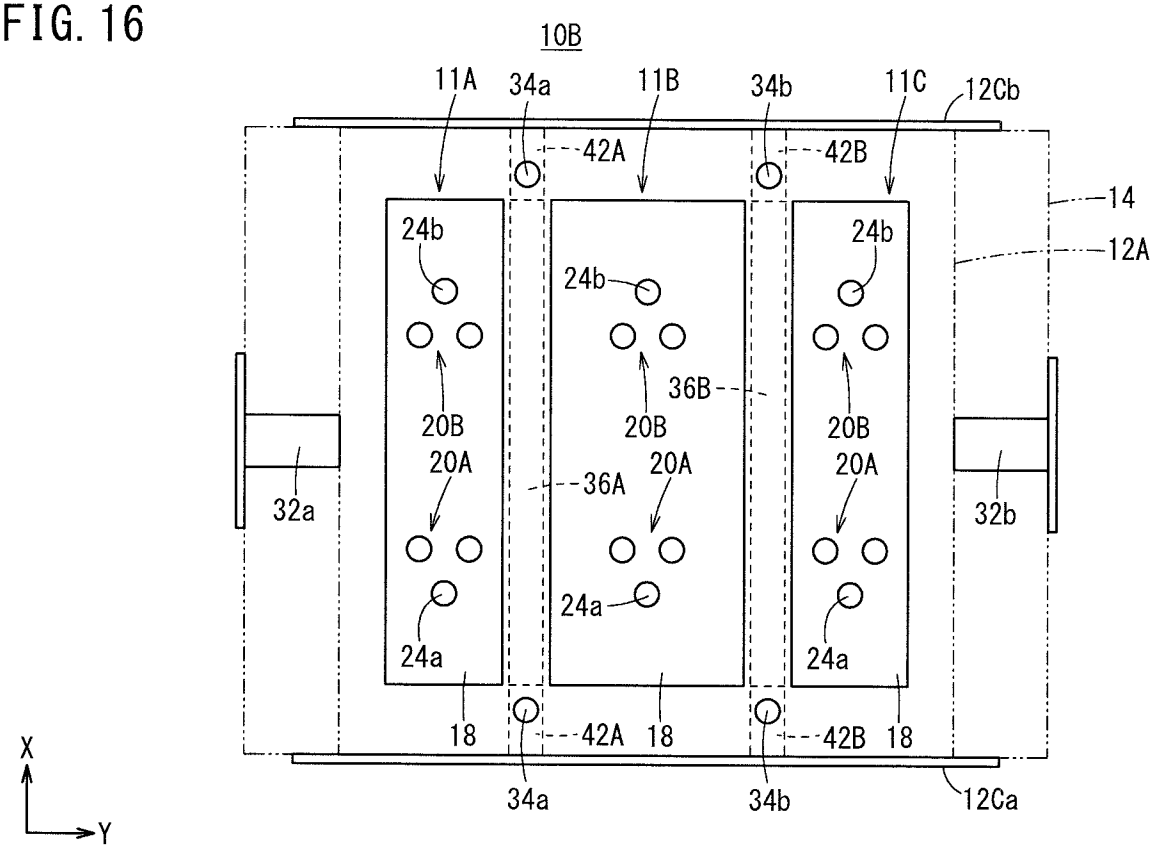
FIG. 16 is a plan view showing the filter according to the third embodiment.

A filter according to a third embodiment will be described using the drawings. FIG. 14 is a perspective view showing the filter according to the present embodiment. FIGS. 15A and 15B are cross-sectional views showing the filter according to the present embodiment. FIG. 15A corresponds to the line XVA-XVA of FIG. 14. FIG. 15B corresponds to the line XVB-XVB of FIG. 14. FIG. 16 is a plan view showing the filter according to the present embodiment. Configuring elements similar to in the filters according to the first and second embodiments will be assigned with the same symbols as in the first and second embodiments, and descriptions thereof will be omitted or simplified.

A filter 10B according to the present embodiment is one which is provided with coupling adjustment via electrodes 34*a*, 34*b* whose ends are connected to the upper shielding conductor 12A and whose other ends are connected to the lower shielding conductor 12B.

The coupling adjustment via electrode 34*a* is connected to the shielding conductors 12A, 12B within an extension region 42A which is an extension in the X direction of a region 36A between the strip line 18 of the resonator 11A and the strip line 18 of the resonator 11B. Moreover, the coupling adjustment via electrode 34*b* is connected to the shielding conductors 12A, 12B within an extension region 42B which is an extension in the X direction of a region 36B between the strip line 18 of the resonator 11B and the strip line 18 of the resonator 11C. The coupling adjustment via electrode 34*a* generates a magnetic field of a kind that will counteract coupling between the resonator 11A and the resonator 11B. Moreover, the coupling adjustment via electrode 34*b* generates a magnetic field of a kind that will counteract coupling between the resonator 11B and the resonator 11C. The coupling adjustment via electrodes 34*a*, 34*b* may function as side surface grounds, similarly to the first side surface shielding conductor 12Ca and the second side surface shielding conductor 12Cb. Therefore, if positions or numbers of the coupling adjustment via electrodes 34*a*, 34*b* are made different, then distances from the resonators 11A to 11C to the side surface grounds can be made different. Therefore, in the present embodiment, there is obtained behavior similar to when the filter is formed in a small area. Due to the present embodiment, the coupling degree between the resonators 11A to 11C can be adjusted without size of the filter being changed, and hence filters of various characteristics can be formed with the same size. Since filters of various characteristics can be formed with the same size, filters of various characteristics can be manufactured by the same manufacturing steps and the same manufacturing method.

Due to the present embodiment, the coupling degree between the resonator 11A and the resonator 11B can be reduced due to there being provided such a coupling adjustment via electrode 34*a*. Moreover, due to the present embodiment, the coupling degree between the resonator 11B and the resonator 11C can be reduced due to there being formed such a coupling adjustment via electrode 34*b*. Therefore, due to the present embodiment, the coupling degree between the mutually adjacent resonators 11A to 11C can be reduced, without the distance in the Y direction between the mutually adjacent resonators 11A to 11C being increased. Hence, due to the present embodiment, the coupling degree between the mutually adjacent resonators 11A to 11C can be reduced while size of the filter 10B is kept small.

Modified Example

Figure 17A:
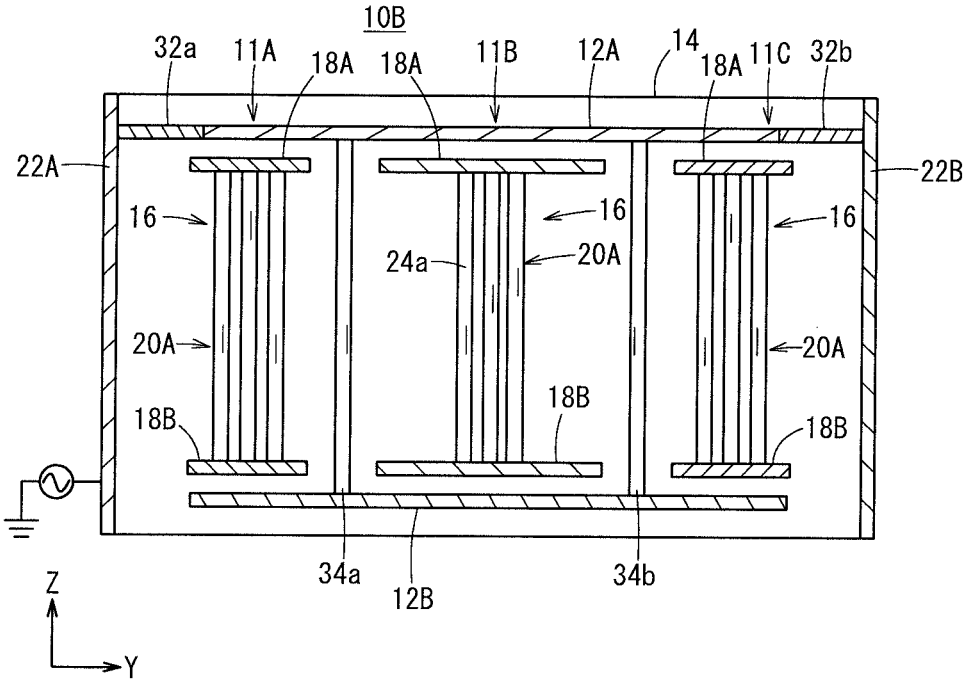
FIGS. 17A and 17B are cross-sectional views showing a filter according to a modified example of the third embodiment.
Figure 17B:
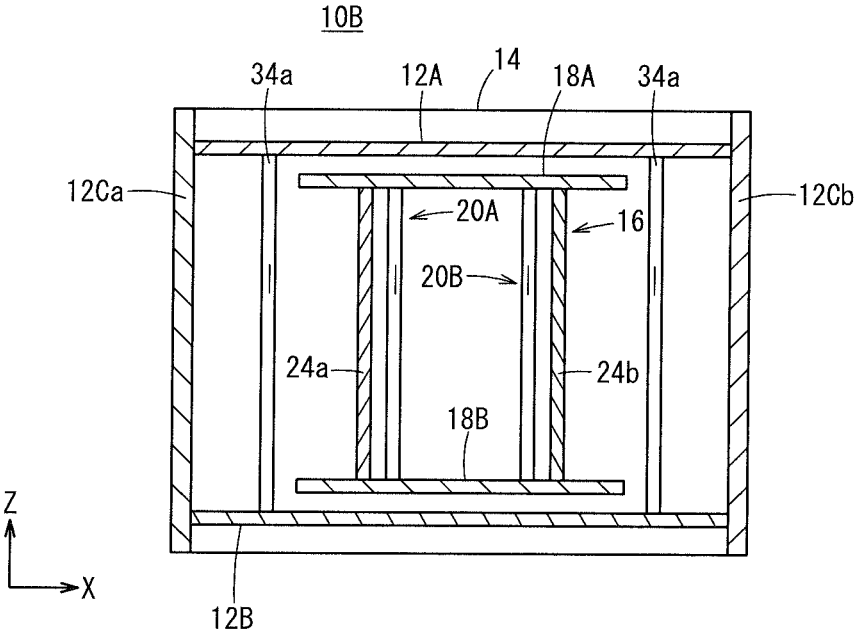

A filter according to a modified example of the present embodiment will be described using FIGS. 17A and 17B. FIGS. 17A and 17B are cross-sectional views showing the filter according to the present modified example.

The present modified example is one in which the dielectric substrate 14 has formed therein: the upper strip line 18A that faces the upper shielding conductor 12A; and the lower strip line 18B that faces the lower shielding conductor 12B.

Due to the present modified example, the via electrode portions 20A, 20B do not contact either the upper shielding conductor 12A or the lower shielding conductor 12B. Therefore, in the present modified example, a local concentration of current is prevented from occurring in the upper shielding conductor 12A and the lower shielding conductor 12B, and meanwhile, current can be concentrated in vicinities of centers of the via electrode portions 20A, 20B. Since it is the via electrode portions 20A, 20B alone where current concentrates, that is, since current concentrates where there is continuity (linearity), the present modified example enables the Q-factor to be improved.

Preferred embodiments of the present invention have been presented and described above. However, the present invention is not limited to the above-described embodiments, and a variety of modifications is possible within a range not departing from the gist of the present invention.

The above-described embodiments may be summarized as follows.

The filter (10) includes the plurality of resonators (11A to 11C), the plurality of resonators each including the via electrode portion (20A, 20B) which is formed within the dielectric substrate (14), and the plurality of resonators each including the first strip line (18) which is connected to one end of the via electrode portion and which faces the first shielding conductor (12B) among the plurality of shielding conductors (12A, 12B, 12Ca, 12Cb) that are formed so as to surround the via electrode portion, wherein a position of the via electrode portion of the first resonator (11A) among the plurality of resonators and a position of the via electrode portion of the second resonator (11B) adjacent to the first resonator are offset from each other in the first direction (X) being a longitudinal direction of the first strip line. Due to such a configuration, positions of the via electrode portions differ from each other in the first direction, among mutually adjacent resonators. Therefore, due to such a configuration, distance between the via electrode portions can be increased, and coupling degree between the mutually adjacent resonators can be reduced, without distance between the mutually adjacent resonators being increased. Hence, due to such a configuration, the coupling degree between the mutually adjacent resonators can be reduced while size of the filter is kept small.

A configuration may be adopted whereby the first shielding conductor is formed on one principal surface side of the dielectric substrate, the dielectric substrate includes the first side surface (14*c*) whose normal direction is the first direction, and the second side surface (14*d*) that faces the first side surface, the first resonator and the second resonator each include a plurality of the via electrode portions, a first via electrode portion among the plurality of via electrode portions is positioned near the first side surface, a second via electrode portion among the plurality of via electrode portions is positioned near the second side surface, a position in the first direction of the first via electrode portion of the first resonator and a position in the first direction of the first via electrode portion of the second resonator differ from each other, and a position in the first direction of the second via electrode portion of the first resonator and a position in the first direction of the second via electrode portion of the second resonator differ from each other. Due to such a configuration too, the coupling degree between the mutually adjacent resonators can be reduced while size of the filter is kept small.

A configuration may be adopted whereby the dielectric substrate further includes the third side surface (14*a*) whose normal direction is the second direction (Y) intersecting the first direction, and the fourth side surface (14*b*) that faces the third side surface, the filter further includes the input/output terminal (22A) which is formed on the third side surface, and which is connected to the second shielding conductor (12A) that faces the first shielding conductor, the first resonator is positioned between the input/output terminal and the second resonator, and the distance (L1X) in the first direction between the first via electrode portion of the first resonator and the second via electrode portion of the first resonator is smaller than the distance (L2X) in the first direction between the first via electrode portion of the second resonator and the second via electrode portion of the second resonator. Due to such a configuration, coupling degree between the via electrode portion of the first resonator and the input/output terminal can be increased while coupling degree between the via electrode portion of the first resonator and the via electrode portion of the second resonator is reduced.

A configuration may be adopted whereby the dielectric substrate further includes a first side surface whose normal direction is the first direction, a second side surface that faces the first side surface, a third side surface whose normal direction is a second direction intersecting the first direction, and a fourth side surface that faces the third side surface, the filter further includes an input/output terminal which is formed on the third side surface, and which is connected to a second shielding conductor that faces the first shielding conductor, the first resonator is positioned between the input/output terminal and the second resonator, the first resonator includes one of the via electrode portions (20C), the second resonator includes a plurality of the via electrode portions (20A, 20B), a first via electrode portion among the plurality of via electrode portions of the second resonator is positioned near the first side surface, a second via electrode portion among the plurality of via electrode portions of the second resonator is positioned near the second side surface, a position of the via electrode portion of the first resonator and a position of the first via electrode portion of the second resonator are offset in the first direction, and the position of the via electrode portion of the first resonator and a position of the second via electrode portion of the second resonator are offset in the first direction.

A configuration may be adopted whereby the via electrode portion of the first resonator is positioned at a center in the first direction of the first strip line of the first resonator. Due to such a configuration, coupling degree between the via electrode portion and the input/output terminal can be increased, and, meanwhile, coupling degree between the via electrode portion of the first resonator and the via electrode portion of the second resonator can be reduced.

A configuration may be adopted whereby the position in the second direction of the center (P1) of the via electrode portion of the first resonator is positioned closer to the third side surface than a position in the second direction of a center of the first strip line of the first resonator is. Due to such a configuration, coupling degree between the via electrode portion and the input/output terminal can be increased, and, meanwhile, coupling degree between the via electrode portion of the first resonator and the via electrode portion of the second resonator can be reduced.

A configuration may be adopted whereby the via electrode portion of the first resonator is configured from the plurality of via electrodes (24*c*), and the plurality of via electrodes configuring the via electrode portion of the first resonator are arranged along the imaginary straight line (40), when viewed from an upper surface. Due to such a configuration, coupling degree between the via electrode portion and the input/output terminal can be increased, and, meanwhile, coupling degree between the via electrode portion of the first resonator and the via electrode portion of the second resonator can be reduced.

A configuration may be adopted whereby the via electrode portion of the first resonator is configured from the plurality of via electrodes (24*c*1 to 24*c*3), the first via electrode (24*c*1) among the plurality of via electrodes of the first resonator is positioned near the first side surface with respect to the second via electrode (24*c*2) among the plurality of via electrodes of the first resonator, the third via electrode (24*c*3) among the plurality of via electrodes of the first resonator is positioned near the second side surface with respect to the second via electrode among the plurality of via electrodes of the first resonator, and the distance (L1Y2) between the second via electrode and the third side surface is larger than the distance (L1Y1) between the first via electrode and the third side surface, and is larger than the distance (L1Y3) between the third via electrode and the third side surface. Due to such a configuration, coupling degree between the via electrode portion of the first resonator and the via electrode portion of the second resonator can be reduced, while coupling degree between the via electrode portion and the input/output terminal is prevented from becoming excessively large.

The filter (10A) includes: the plurality of resonators, the plurality of resonators each including the via electrode portion which is formed within a dielectric substrate, and the plurality of resonators each including the first strip line which is connected to one end of the via electrode portion and which faces the first shielding conductor among the plurality of shielding conductors that are formed so as to surround the via electrode portion; and the slit (30A) which is formed in the second shielding conductor that faces the first shielding conductor, wherein the slit is positioned at least between the via electrode portion of the first resonator among the plurality of resonators and the via electrode portion of the second resonator among the plurality of resonators. Due to such a configuration, the second shielding conductor is provided with a slit between mutually adjacent resonators. Therefore, due to such a configuration, coupling degree between the mutually adjacent resonators can be reduced, without distance between the resonators being increased. Hence, due to such a configuration, the coupling degree between the mutually adjacent resonators can be reduced while size of the filter is kept small.

A configuration may be adopted whereby the dielectric substrate further includes the third side surface whose normal direction is the second direction that intersects the first direction being a longitudinal direction of the first strip line, and the fourth side surface that faces the third side surface, and the filter further includes the input/output terminal which is formed on the third side surface, and which is connected to the second shielding conductor.

The filter (10B) includes: the plurality of resonators, the plurality of resonators each including the via electrode portion which is formed within the dielectric substrate, and the plurality of resonators each including the first strip line which is connected to one end of the via electrode portion and which faces the first shielding conductor among the plurality of shielding conductors that are formed so as to surround the via electrode portion; and the coupling adjustment via electrode (34*a*) that, within the extension region (42A) which is an extension in the first direction being a longitudinal direction of the first strip line, of the region (36A) between the first strip line of the first resonator among the plurality of resonators and the first strip line of the second resonator adjacent to the first resonator, has its one end connected to the first shielding conductor and has its another end connected to the second shielding conductor that faces the first shielding conductor. In such a configuration, a coupling adjustment via electrode is provided, hence due to such a configuration, coupling degree between the mutually adjacent resonators can be reduced, without distance between the mutually adjacent resonators being increased. Hence, due to such a configuration, the coupling degree between the mutually adjacent resonators can be reduced while size of the filter is kept small.

A configuration may be adopted whereby the dielectric substrate further includes the third side surface whose normal direction is the second direction intersecting the first direction, and the fourth side surface that faces the third side surface, and the filter further includes the input/output terminal which is formed on the third side surface, and which is connected to the second shielding conductor.

A configuration may be adopted whereby the first resonator and the second resonator each include the plurality of the via electrode portions, the dielectric substrate further includes the first side surface whose normal direction is a longitudinal direction of the first strip line, and the second side surface that faces the first side surface, the first via electrode portion among the plurality of via electrode portions is positioned near the first side surface, and the second via electrode portion among the plurality of via electrode portions is positioned near the second side surface.

A configuration may be adopted whereby another end of the via electrode portion is connected to the second shielding conductor.

A configuration may be adopted whereby the filter further includes a second strip line which is connected to another end of the via electrode portion, and which faces the second shielding conductor, within the dielectric substrate. Due to such a configuration, a local concentration of current is prevented from occurring in the first shielding conductor and the second shielding conductor, and, at the same time, sufficient current can be concentrated in a vicinity of a center of the via electrode portion. Hence, due to such a configuration, a filter with a good Q-factor can be obtained.

A configuration may be adopted whereby the first via electrode portion and the second via electrode portion are each configured from the plurality of via electrodes, the plurality of via electrodes configuring the first via electrode portion are arranged along the imaginary first curved line (28*a*), when viewed from an upper surface, and the plurality of via electrodes configuring the second via electrode portion are arranged along the imaginary second curved line (28*b*), when viewed from an upper surface.

A configuration may be adopted whereby the first curved line and the second curved line configure parts of the single elliptical shape (37) or parts of the single track shape (38).

REFERENCE SIGNS LIST

10, 10A, 10B: filter
11A to 11C: resonator
12A: upper shielding conductor
12B: lower shielding conductor
12Ca: first side surface shielding conductor
12Cb: second side surface shielding conductor
14: dielectric substrate
14*a* to 14*d*: side surface
16: structure
18: strip line, first strip line
18A: upper strip line, second strip line
18B: lower strip line, first strip line
20A: first via electrode portion
20B: second via electrode portion
20C: third via electrode portion
22A: first input/output terminal
22B: second input/output terminal
24*a* to 24*c*: via electrode
24*c*1: first via electrode
24*c*2: second via electrode
24*c*3: third via electrode
26: imaginary rhombus
28*a*: imaginary first curved line
28*b*: imaginary second curved line
30A, 30B: slit
32*a*: first connection line
32*b*: second connection line
33A: first portion
33B: second portion
33C: third portion
34*a*, 34*b*: coupling adjustment via electrode
36A, 36B: region
37: imaginary elliptical shape
38: imaginary track shape
40: straight line
42A, 42B: extension region
L1X to L3X, L1Y1 to L1Y3, L3Y1 to L3Y3: distance

The invention claimed is:

1. A filter comprising a plurality of resonators, the plurality of resonators each including a via electrode portion which is formed within a dielectric substrate, and the plurality of resonators each including a first strip line which has a longitudinal extending direction, that is directly connected to one end of the via electrode portion, with the via electrode portion having a length that extends continuously from the one end to another end of the via electrode portion, and the first strip line faces a first shielding conductor among a plurality of shielding conductors, such that a second shielding conductor, which is on a side opposite to the first shielding conductor, is directly connected to the other end of the via electrode portion, wherein a position of an entire length of the via electrode portion of a first resonator among the plurality of resonators and a position of an entire length of the via electrode portion of a second resonator adjacent to the first resonator are offset from each other in a first direction being the longitudinal extending direction of the first strip line.

2. A filter comprising a plurality of resonators, the plurality of resonators each including a via electrode portion which is formed within a dielectric substrate, and the plurality of resonators each including a first strip line which is connected to one end of the via electrode portion and which faces a first shielding conductor among a plurality of shielding conductors that are formed so as to surround the via electrode portion, wherein a position of the via electrode portion of a first resonator among the plurality of resonators and a position of the via electrode portion of a second resonator adjacent to the first resonator are offset from each other in a first direction being a longitudinal direction of the first strip line, the first shielding conductor is formed on one principal surface side of the dielectric substrate, the dielectric substrate includes a first side surface whose normal direction is the first direction, and a second side surface that faces the first side surface, the first resonator and the second resonator each include a plurality of the via electrode portions, a first via electrode portion among the plurality of via electrode portions is positioned near the first side surface, a second via electrode portion among the plurality of via electrode portions is positioned near the second side surface, a position in the first direction of the first via electrode portion of the first resonator and a position in the first direction of the first via electrode portion of the second resonator differ from each other, and a position in the first direction of the second via electrode portion of the first resonator and a position in the first direction of the second via electrode portion of the second resonator differ from each other.

3. The filter according to claim 2, wherein the dielectric substrate further includes a third side surface whose normal direction is a second direction intersecting the first direction, and a fourth side surface that faces the third side surface, the filter further includes an input/output terminal which is formed on the third side surface, and which is connected to a second shielding conductor that faces the first shielding conductor, the first resonator is positioned between the input/output terminal and the second resonator, and a distance in the first direction between the first via electrode portion of the first resonator and the second via electrode portion of the first resonator is smaller than a distance in the first direction between the first via electrode portion of the second resonator and the second via electrode portion of the second resonator.

4. The filter according to claim 3, wherein another end of the via electrode portion is connected to the second shielding conductor.

5. The filter according to claim 3, further including a second strip line which is connected to another end of the via electrode portion, and which faces the second shielding conductor, within the dielectric substrate.

6. The filter according to claim 2, wherein the first via electrode portion and the second via electrode portion are each configured from a plurality of via electrodes, the plurality of via electrodes configuring the first via electrode portion are arranged along an imaginary first curved line, when viewed from an upper surface, and the plurality of via electrodes configuring the second via electrode portion are arranged along an imaginary second curved line, when viewed from an upper surface.

7. The filter according to claim 6, wherein the first curved line and the second curved line configure parts of a single elliptical shape or parts of a single track shape.

8. A filter comprising a plurality of resonators, the plurality of resonators each including a via electrode portion which is formed within a dielectric substrate, and the plurality of resonators each including a first strip line which is connected to one end of the via electrode portion and which faces a first shielding conductor among a plurality of shielding conductors that are formed so as to surround the via electrode portion, wherein a position of the via electrode portion of a first resonator among the plurality of resonators and a position of the via electrode portion of a second resonator adjacent to the first resonator are offset from each other in a first direction being a longitudinal direction of the first strip line, the dielectric substrate further includes a first side surface whose normal direction is the first direction, a second side surface that faces the first side surface, a third side surface whose normal direction is a second direction intersecting the first direction, and a fourth side surface that faces the third side surface, the filter further includes an input/output terminal which is formed on the third side surface, and which is connected to a second shielding conductor that faces the first shielding conductor, the first resonator is positioned between the input/output terminal and the second resonator, the first resonator includes one of the via electrode portions, the second resonator includes a plurality of the via electrode portions, a first via electrode portion among the plurality of via electrode portions of the second resonator is positioned near the first side surface, a second via electrode portion among the plurality of via electrode portions of the second resonator is positioned near the second side surface, a position of the via electrode portion of the first resonator and a position of the first via electrode portion of the second resonator are offset in the first direction, and the position of the via electrode portion of the first resonator and a position of the second via electrode portion of the second resonator are offset in the first direction.

9. The filter according to claim 8, wherein the via electrode portion of the first resonator is configured from a plurality of via electrodes, and the plurality of via electrodes configuring the via electrode portion of the first resonator are arranged along an imaginary straight line, when viewed from an upper surface.

10. The filter according to claim 8, wherein the via electrode portion of the first resonator is configured from a plurality of via electrodes, a first via electrode among the plurality of via electrodes of the first resonator is positioned near the first side surface with respect to a second via electrode among the plurality of via electrodes of the first resonator, a third via electrode among the plurality of via electrodes of the first resonator is positioned near the second side surface with respect to the second via electrode among the plurality of via electrodes of the first resonator, and a distance between the second via electrode and the third side surface is larger than a distance between the first via electrode and the third side surface, and is larger than a distance between the third via electrode and the third side surface.

11. The filter according to claim 8, wherein the via electrode portion of the first resonator is positioned at a center in the first direction of the first strip line of the first resonator.

12. The filter according to claim 11, wherein a position in the second direction of the center of the via electrode portion of the first resonator is closer to the third side surface than a position in the second direction of a center of the first strip line of the first resonator is to the third side surface.

13. A filter comprising a plurality of resonators, the plurality of resonators each including a via electrode portion which is formed within a dielectric substrate, and the plurality of resonators each including a first strip line which has a longitudinal extending direction, that is directly connected to one end of the via electrode portion, with the via electrode portion having a length that extends continuously from the one end to another end of the via electrode portion, and the first strip line faces a first shielding conductor among a plurality of shielding conductors, such that a second shielding conductor, which is on a side opposite to the first shielding conductor, is directly connected to the other end of the via electrode portion; and a slit which is formed in the second shielding conductor that faces the first shielding conductor, wherein the slit is positioned at least between the via electrode portion of a first resonator among the plurality of resonators and the via electrode portion of a second resonator among the plurality of resonators, and a position of an entire length of the via electrode portion of the first resonator among the plurality of resonators and a position of an entire length of the via electrode portion of the second resonator adjacent to the first resonator are offset from each other in a first direction being the longitudinal extending direction of the first strip line.

14. A filter comprising a plurality of resonators, the plurality of resonators each including a via electrode portion which is formed within a dielectric substrate, and the plurality of resonators each including a first strip line which is connected to one end of the via electrode portion and which faces a first shielding conductor among a plurality of shielding conductors that are formed so as to surround the via electrode portion; and a slit which is formed in a second shielding conductor that faces the first shielding conductor, wherein the slit is positioned at least between the via electrode portion of a first resonator among the plurality of resonators and the via electrode portion of a second resonator among the plurality of resonators, the dielectric substrate further includes a third side surface whose normal direction is a second direction that intersects a first direction being a longitudinal direction of the first strip line, and a fourth side surface that faces the third side surface, and the filter further includes an input/output terminal which is formed on the third side surface, and which is connected to the second shielding conductor.

15. A filter comprising:

a plurality of resonators, the plurality of resonators each including a via electrode portion which is formed within a dielectric substrate, and the plurality of resonators each including a first strip line which has a longitudinal extending direction, that is directly connected to one end of the via electrode portion, with the via electrode portion having a length that extends continuously from the one end to another end of the via electrode portion, and the first strip line faces a first shielding conductor among a plurality of shielding conductors, such that a second shielding conductor, which is on a side opposite to the first shielding conductor, is directly connected to the other end of the via electrode portion; and a coupling adjustment via electrode that, within an extension region which is an extension in a first direction being the longitudinal extending direction of the first strip line, of a region between the first strip line of a first resonator among the plurality of resonators and the first strip line of a second resonator adjacent to the first resonator, has its one end connected to the first shielding conductor and has its another end connected to the second shielding conductor that faces the first shielding conductor, wherein a position of an entire length of the via electrode portion of the first resonator among the plurality of resonators and a position of an entire length of the via electrode portion of the second resonator adjacent to the first resonator are offset from each other in the first direction being the longitudinal extending direction of the first strip line.

16. A filter comprising:

a plurality of resonators, the plurality of resonators each including a via electrode portion which is formed within a dielectric substrate, and the plurality of resonators each including a first strip line which is connected to one end of the via electrode portion and which faces a first shielding conductor among a plurality of shielding conductors that are formed so as to surround the via electrode portion; and a coupling adjustment via electrode that, within an extension region which is an extension in a first direction being a longitudinal direction of the first strip line, of a region between the first strip line of a first resonator among the plurality of resonators and the first strip line of a second resonator adjacent to the first resonator, has its one end connected to the first shielding conductor and has its another end connected to a second shielding conductor that faces the first shielding conductor, wherein the dielectric substrate further includes a third side surface whose normal direction is a second direction intersecting the first direction, and a fourth side surface that faces the third side surface, and the filter further includes an input/output terminal which is formed on the third side surface, and which is connected to the second shielding conductor.

17. A filter comprising a plurality of resonators, the plurality of resonators each including a via electrode portion which is formed within a dielectric substrate, and the plurality of resonators each including a first strip line which is connected to one end of the via electrode portion and which faces a first shielding conductor among a plurality of shielding conductors that are formed so as to surround the via electrode portion; and a slit which is formed in a second shielding conductor that faces the first shielding conductor, wherein the slit is positioned at least between the via electrode portion of a first resonator among the plurality of resonators and the via electrode portion of a second resonator among the plurality of resonators, the first resonator and the second resonator each include a plurality of the via electrode portions, the dielectric substrate further includes a first side surface whose normal direction is a longitudinal direction of the first strip line, and a second side surface that faces the first side surface, a first via electrode portion among the plurality of via electrode portions is positioned near the first side surface, and a second via electrode portion among the plurality of via electrode portions is positioned near the second side surface.

18. A filter comprising:

a plurality of resonators, the plurality of resonators each including a via electrode portion which is formed within a dielectric substrate, and the plurality of resonators each including a first strip line which is connected to one end of the via electrode portion and which faces a first shielding conductor among a plurality of shielding conductors that are formed so as to surround the via electrode portion; and a coupling adjustment via electrode that, within an extension region which is an extension in a first direction being a longitudinal direction of the first strip line, of a region between the first strip line of a first resonator among the plurality of resonators and the first strip line of a second resonator adjacent to the first resonator, has its one end connected to the first shielding conductor and has its another end connected to a second shielding conductor that faces the first shielding conductor, wherein the first resonator and the second resonator each include a plurality of the via electrode portions, the dielectric substrate further includes a first side surface whose normal direction is the longitudinal direction of the first strip line, and a second side surface that faces the first side surface, a first via electrode portion among the plurality of via electrode portions is positioned near the first side surface, and a second via electrode portion among the plurality of via electrode portions is positioned near the second side surface.

* * * * *